US012102212B2

(12) United States Patent
Jeong

(10) Patent No.: US 12,102,212 B2
(45) Date of Patent: Oct. 1, 2024

(54) MULTIFUNCTIONAL HAIR-STYLING THERMAL TREATMENT BEAUTY DEVICE

(71) Applicant: YEUL, Yeosu-si (KR)

(72) Inventor: Seongyeol Jeong, Yeosu-si (KR)

(73) Assignee: YEUL, Yeosu-si (KR)

( * ) Notice: Subject to any disclaimer, the term of this patent is extended or adjusted under 35 U.S.C. 154(b) by 324 days.

(21) Appl. No.: 17/604,386

(22) PCT Filed: Apr. 14, 2020

(86) PCT No.: PCT/KR2020/005010
§ 371 (c)(1),
(2) Date: Oct. 15, 2021

(87) PCT Pub. No.: WO2020/218770
PCT Pub. Date: Oct. 29, 2020

(65) Prior Publication Data

US 2022/0192338 A1 Jun. 23, 2022

(30) Foreign Application Priority Data

Apr. 24, 2019 (KR) ..... 10-2019-0047671
Mar. 25, 2020 (KR) ..... 10-2020-0036332

(51) Int. Cl.
*A45D 1/04* (2006.01)
*A45D 1/28* (2006.01)
(Continued)

(52) U.S. Cl.
CPC ..... *A45D 6/00* (2013.01); *A45D 1/04* (2013.01); *A45D 1/28* (2013.01); *A45D 2/001* (2013.01)

(58) Field of Classification Search
CPC ... A45D 1/00; A45D 1/04; A45D 1/06; A45D 1/08; A45D 1/10; A45D 1/14; A45D 1/28; A45D 2/001
See application file for complete search history.

(56) References Cited

U.S. PATENT DOCUMENTS 4,211,914 A * 7/1980 Jackson ..... A45D 1/04 219/533
4,267,431 A * 5/1981 Rick ..... A45D 1/10 219/230

(Continued)

FOREIGN PATENT DOCUMENTS

JP S59-64005 A 4/1984
JP S62-192107 A 8/1987

(Continued)

*Primary Examiner* — Rachel R Steitz
(74) *Attorney, Agent, or Firm* — Maschoff Brennan

(57) ABSTRACT

The present invention relates to a multi-functional hair-styling thermal treatment beauty device, which continuously rotates, in a clockwise or counterclockwise direction, a hair-styling part for holding hair while holding body part is held or can open an upper rotary body of the hair-styling part so as to enable hair styling to be easily performed according to circumstances, and forms a continuous grounding structure so as to enable power to be continuously supplied to a heating plate mounted inside the hair-styling part capable of continuously rotating, so that the heated state of the heating plate, caused by the heating of a current, is continuously maintained even during continuous rotation, and thus various hair styles can be more effectively created by the hair-styling part, so that hair styling is easily performed according to circumstances, and operation fatigue is reduced so that use convenience can. be improved.

12 Claims, 22 Drawing Sheets

(51) Int. Cl.
*A45D 2/00* (2006.01)
*A45D 6/00* (2006.01)

(56) References Cited

U.S. PATENT DOCUMENTS

| | | | |
|---|---|---|---|
| 2013/0240498 | A1 | 9/2013 | Tang |
| 2014/0007898 | A1 | 1/2014 | Deng |

FOREIGN PATENT DOCUMENTS

| | | | |
|---|---|---|---|
| JP | S64-36556 | A | 2/1989 |
| JP | 2014-226565 | A | 12/2014 |
| KR | 20-0385754 | Y1 | 6/2005 |
| KR | 20-0394529 | Y1 | 9/2005 |
| KR | 10-1263801 | B1 | 5/2013 |
| KR | 20-2014-0002071 | U | 4/2014 |
| KR | 10-1788727 | B1 | 10/2017 |

* cited by examiner

[FIG. 1]
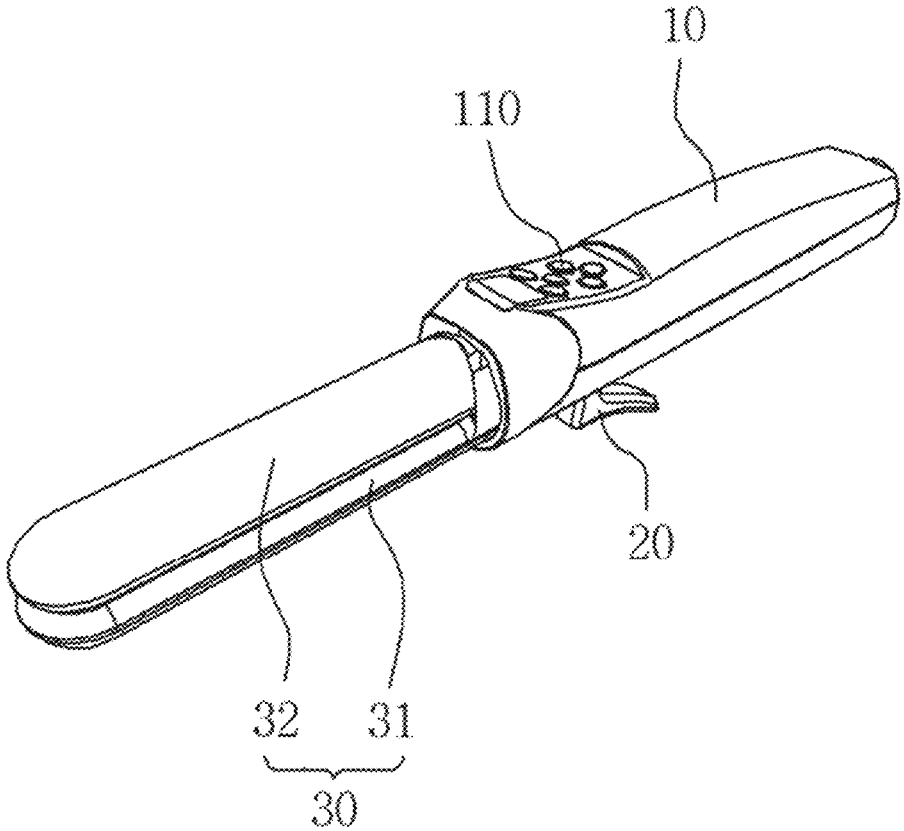

[FIG. 2]
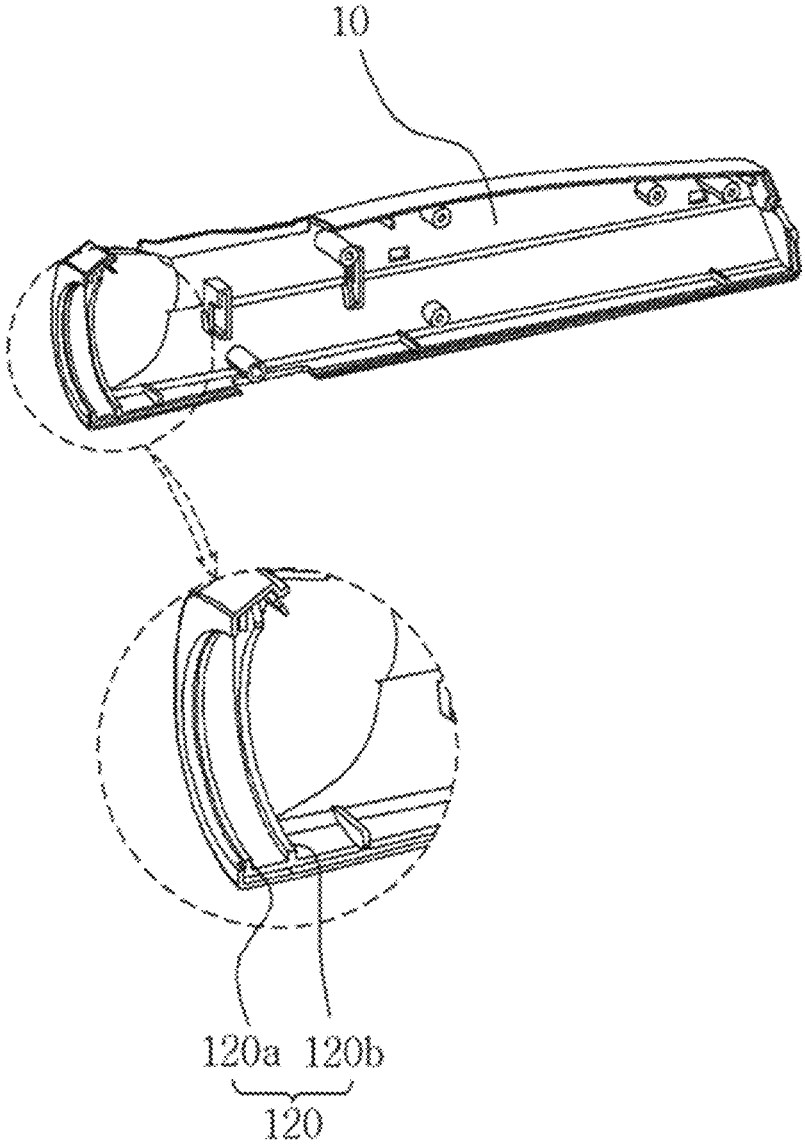

[FIG. 3]
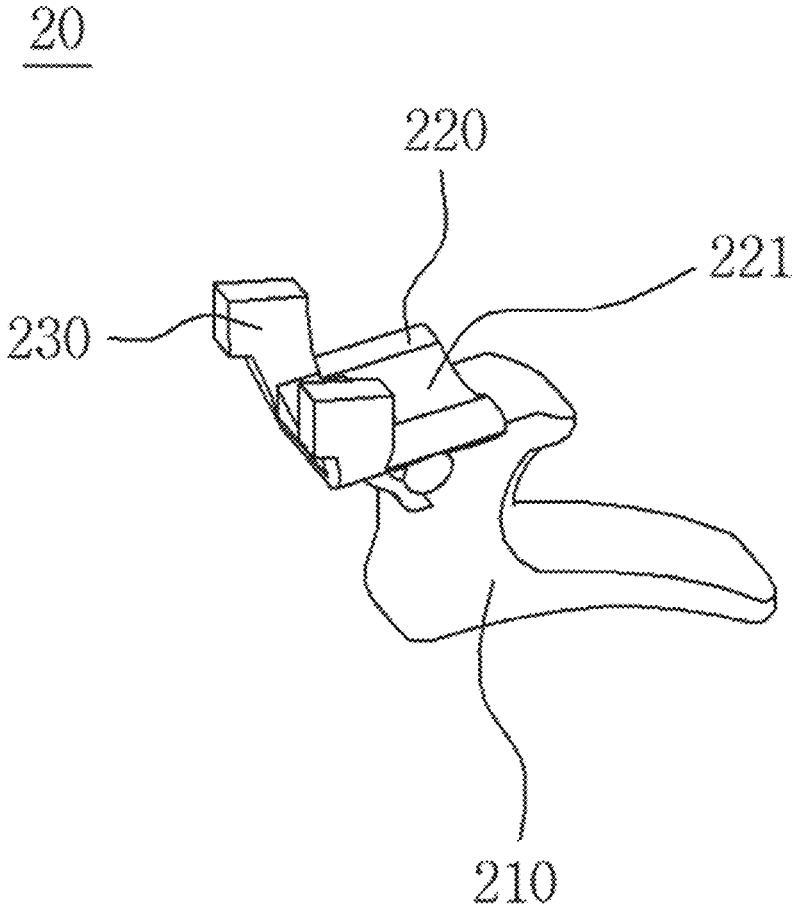

[FIG. 4]
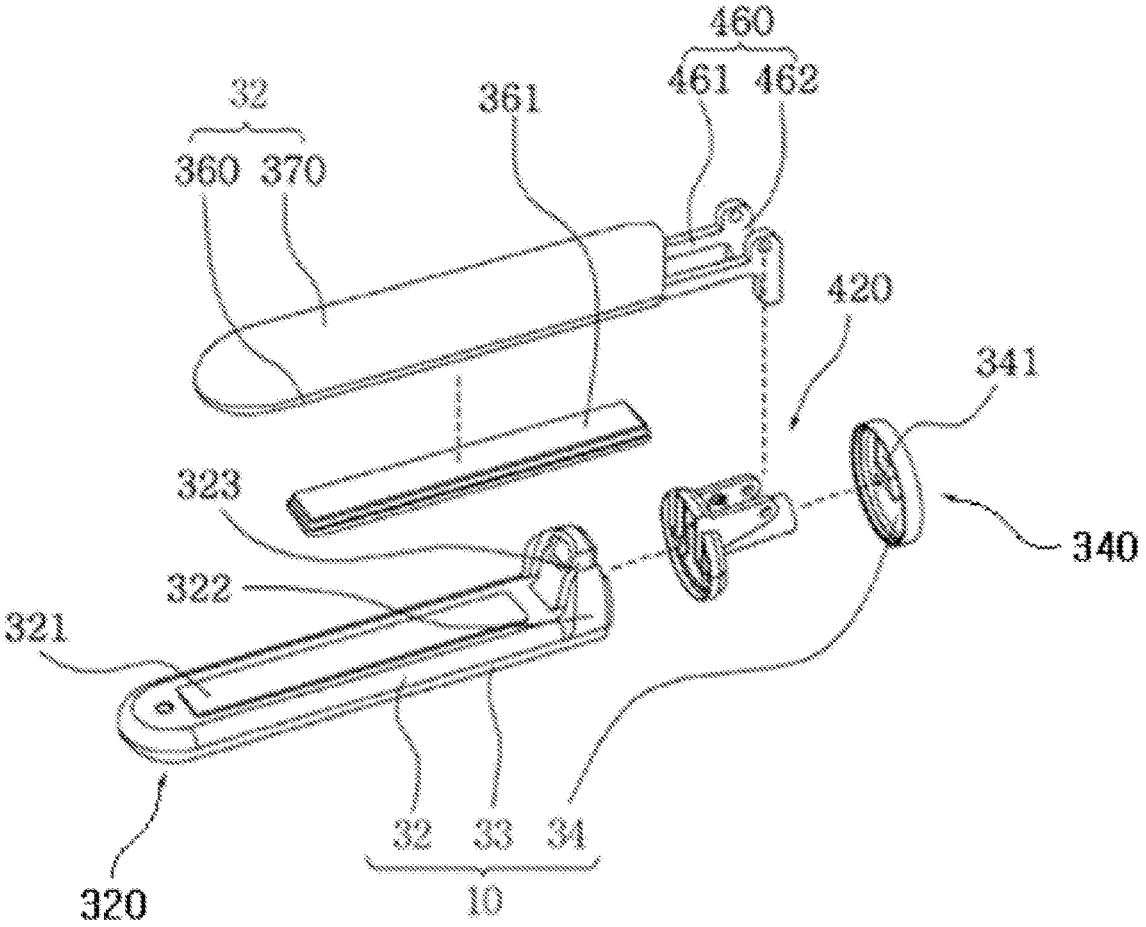

[FIG. 5]
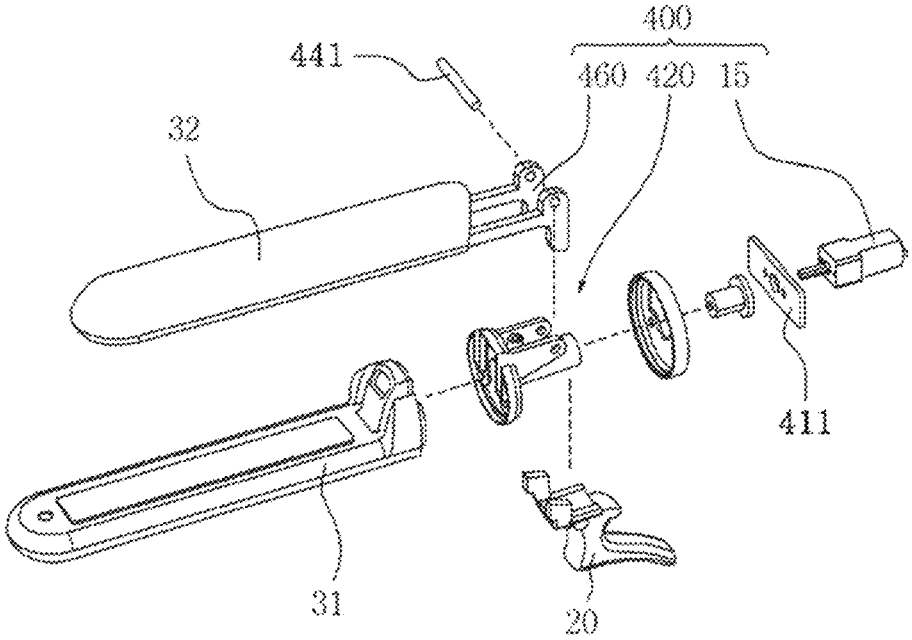
[FIG. 6]
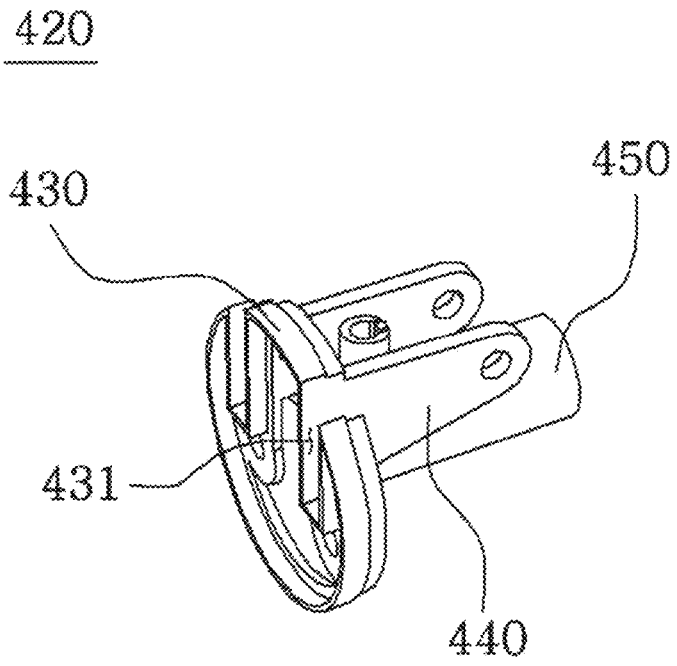

[FIG. 7]
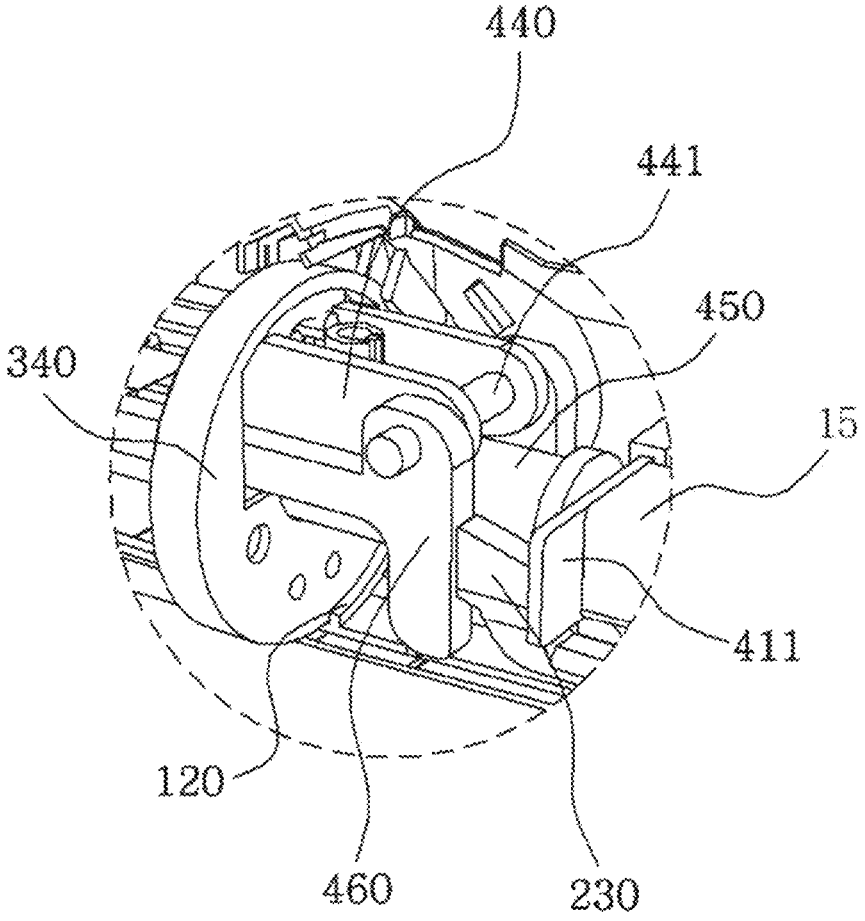

[FIG. 8]
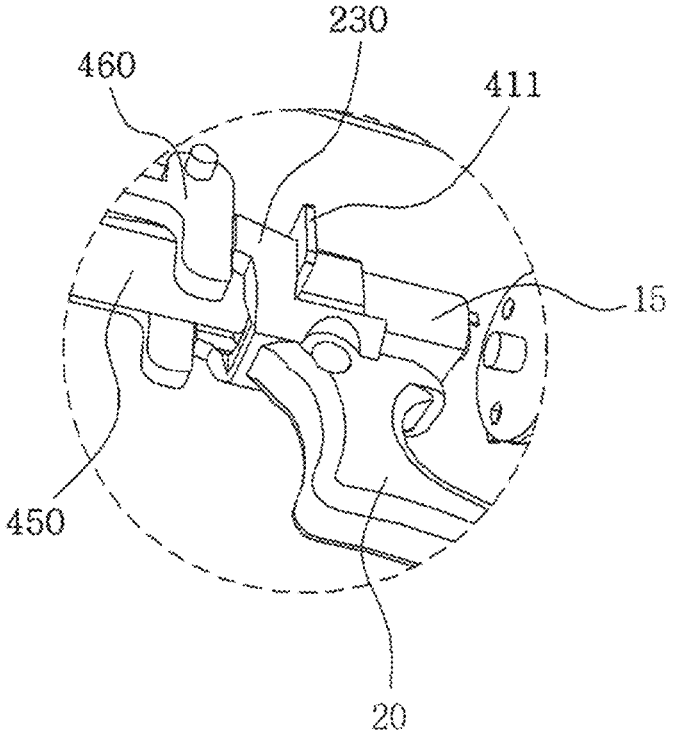
[FIG. 9]
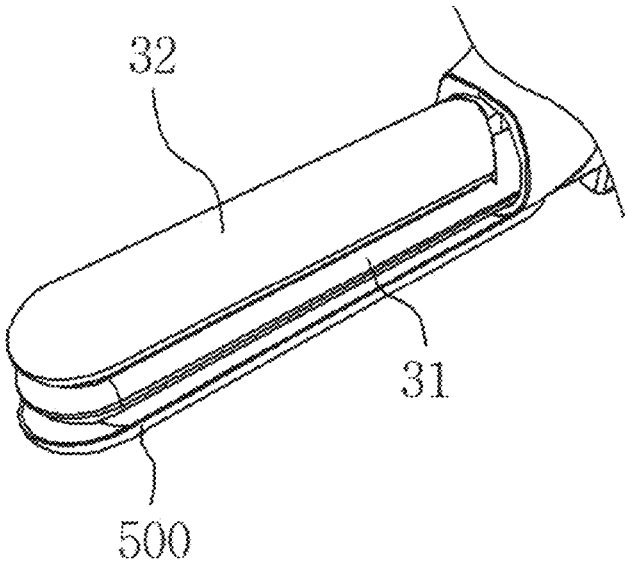

[FIG. 10]
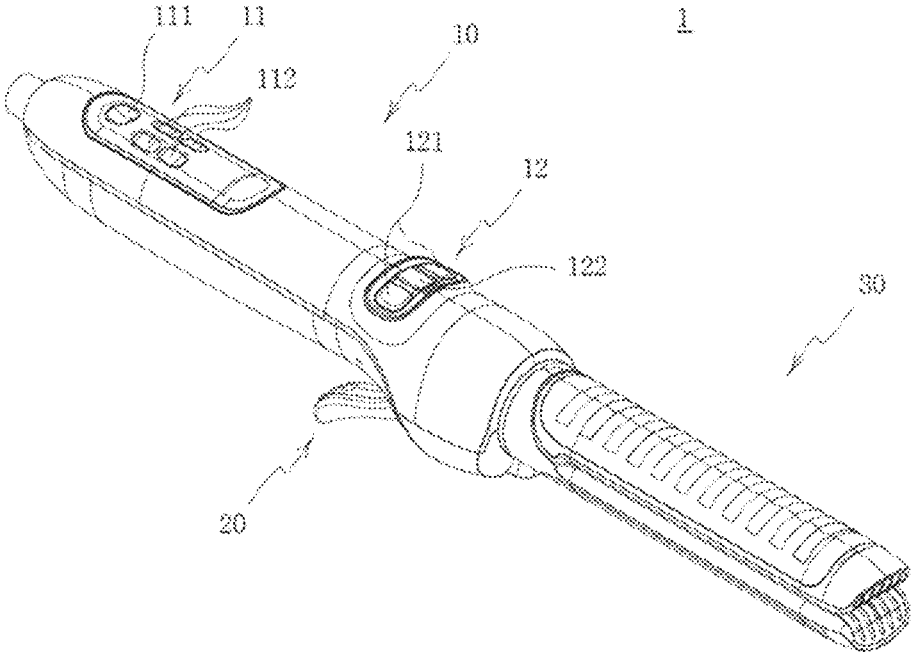
[FIG. 11]
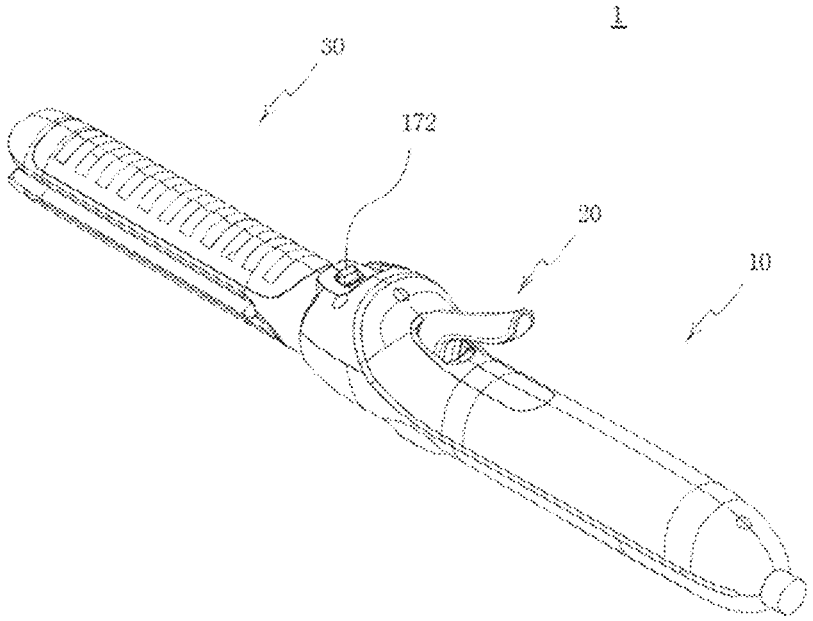

[FIG. 12]
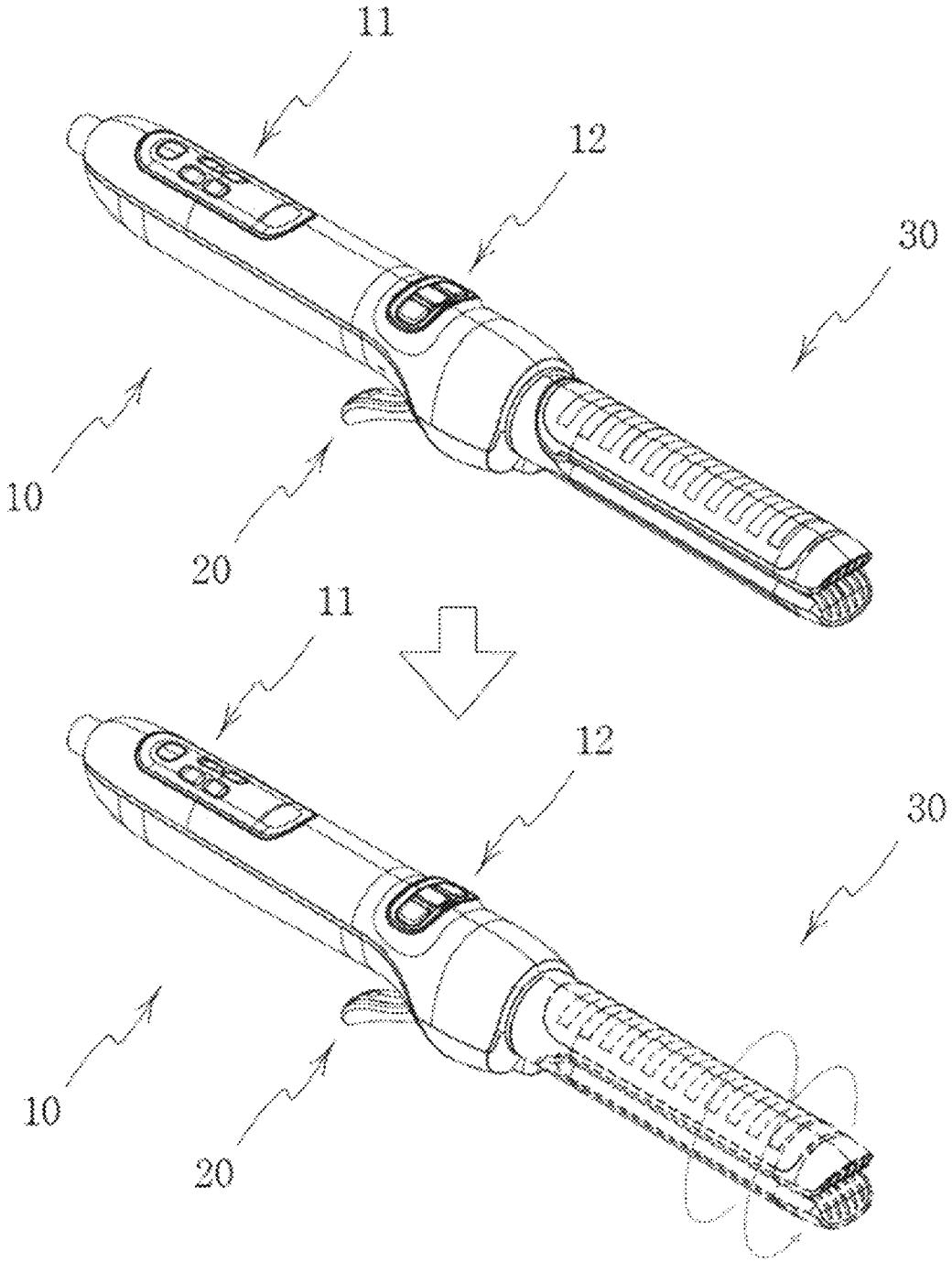

[FIG. 13]
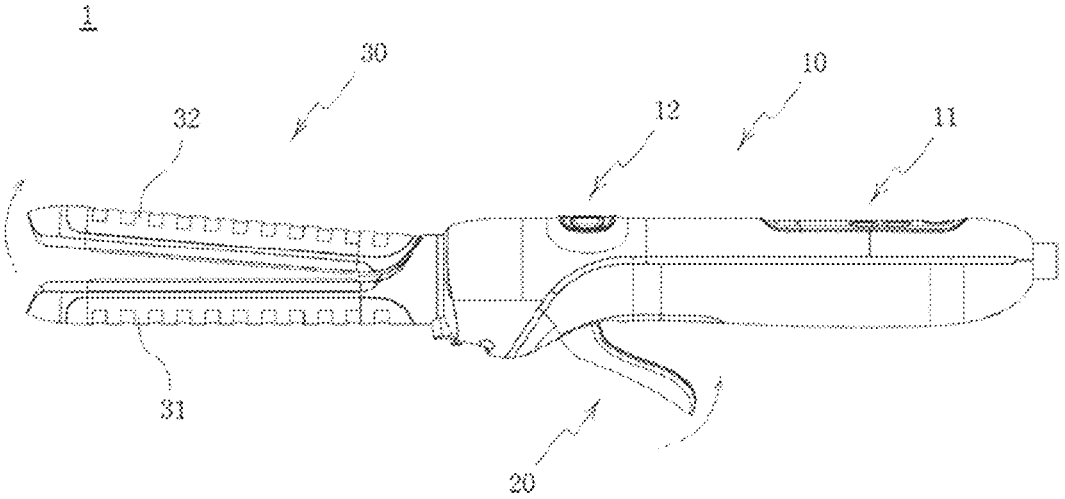

[FIG. 14]
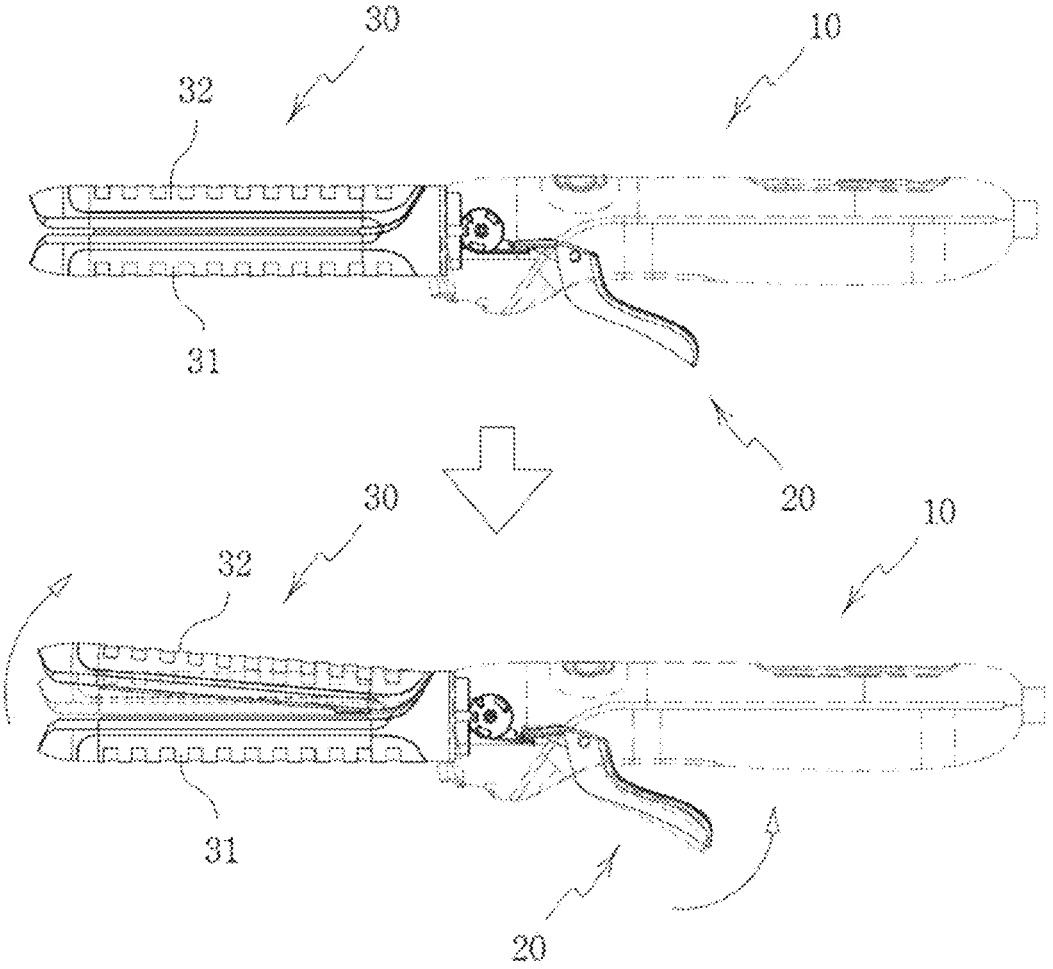

[FIG. 15]
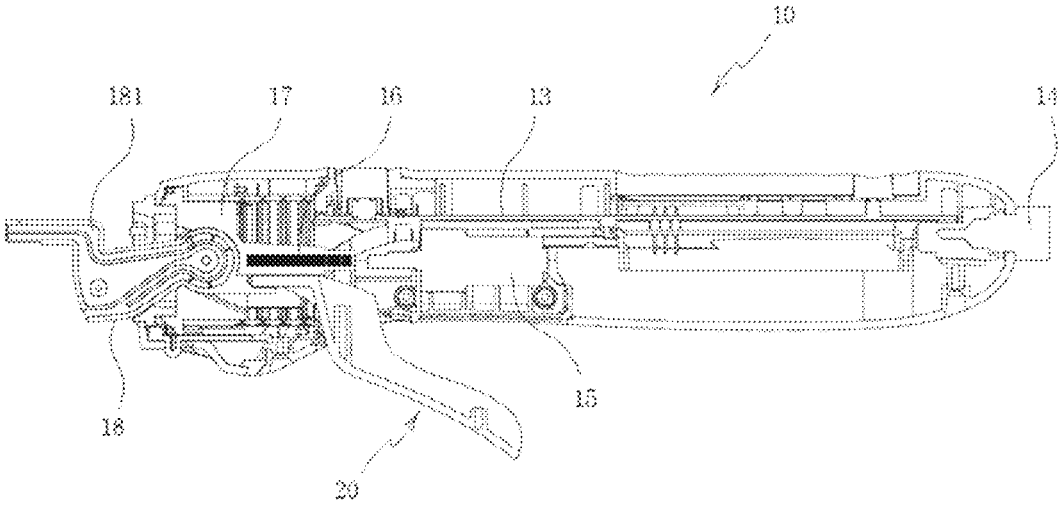
[FIG. 16]
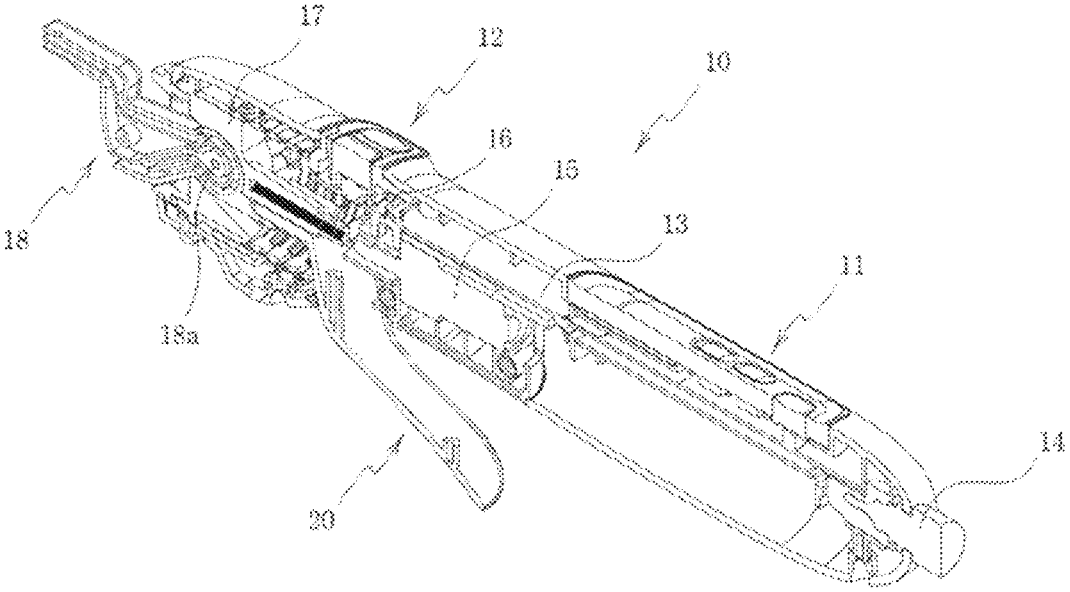

[FIG. 17]
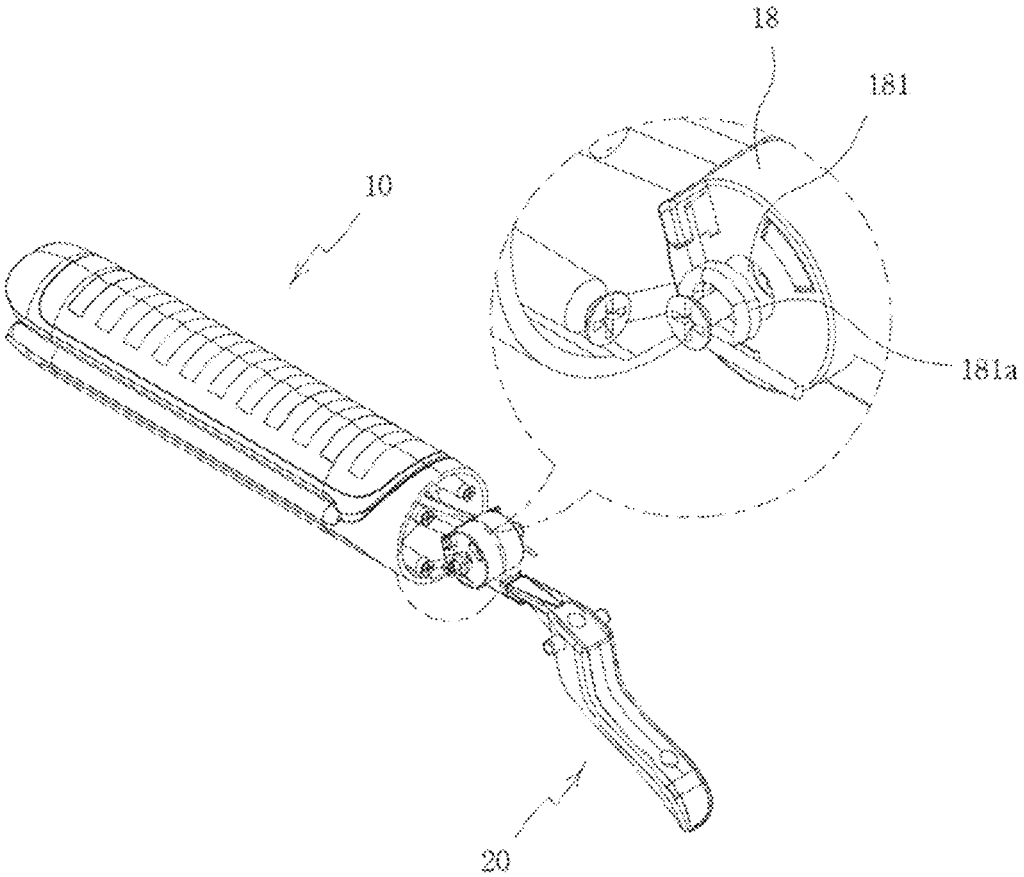

[FIG. 18]
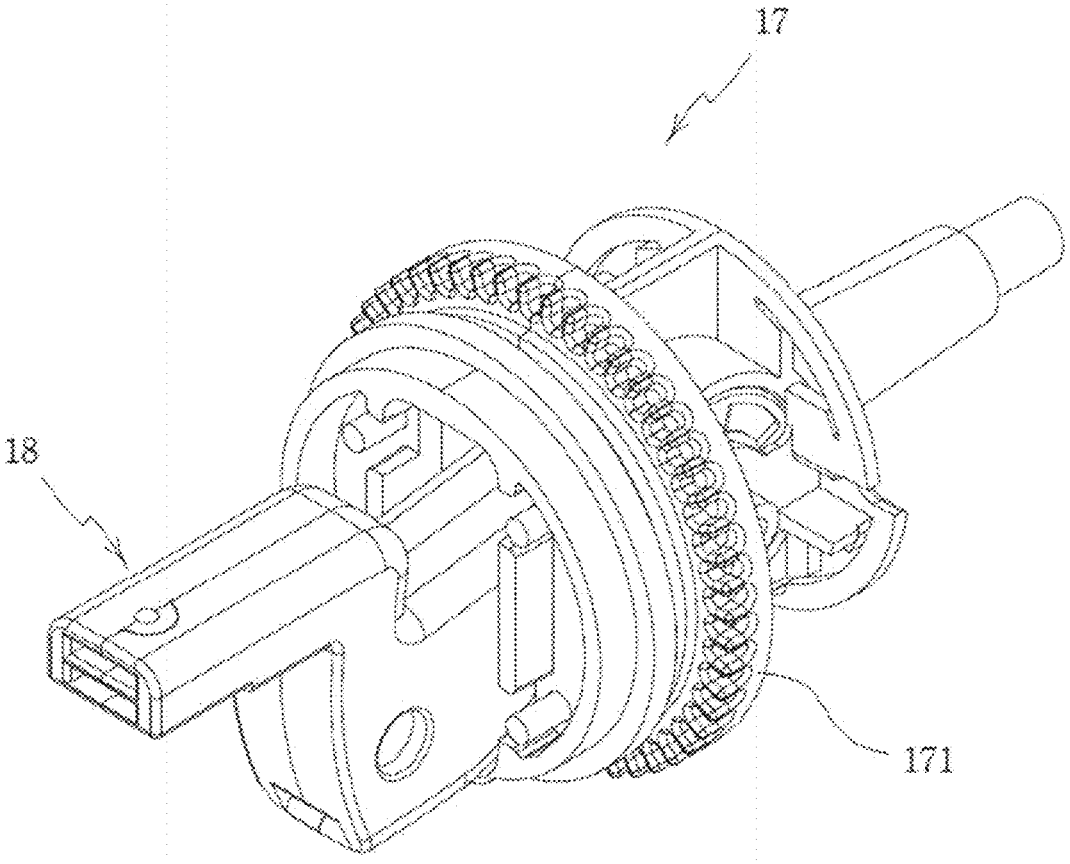

[FIG. 19]
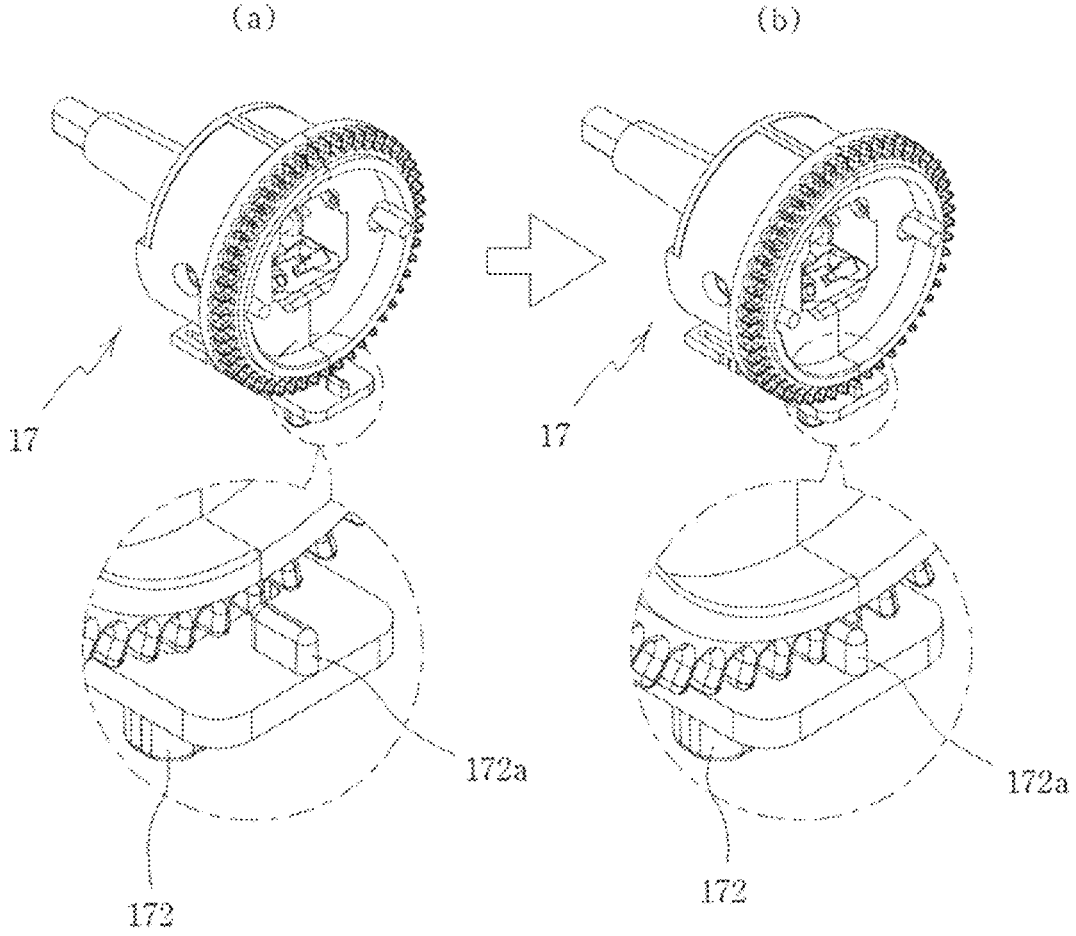

[FIG. 20]
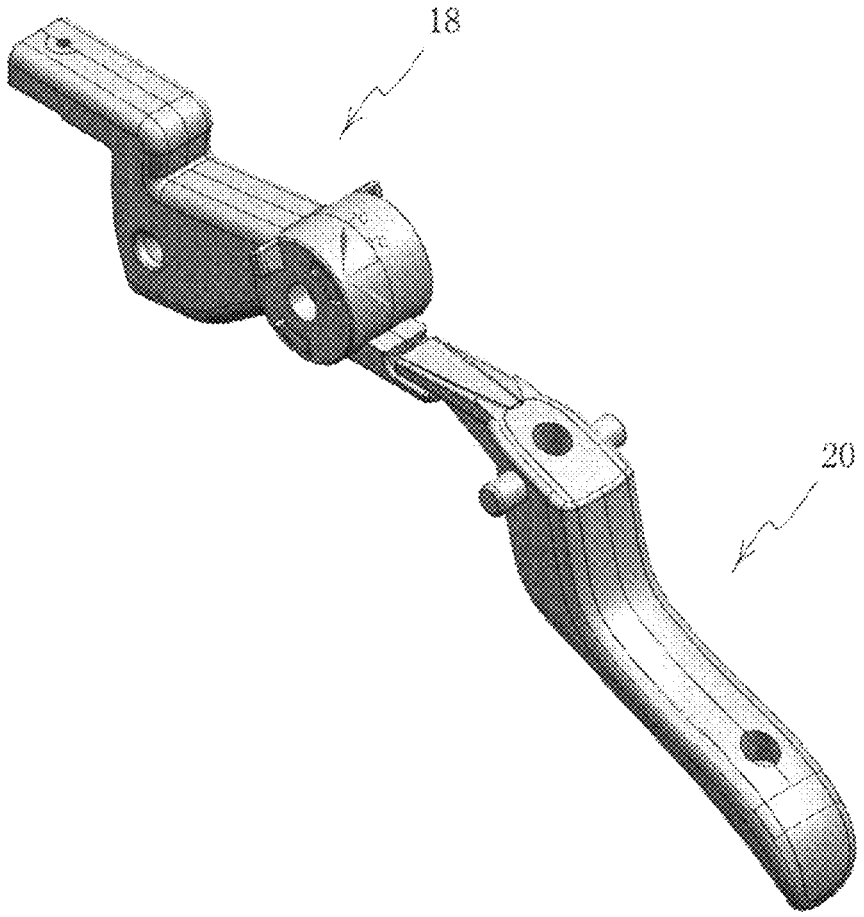

[FIG. 21]
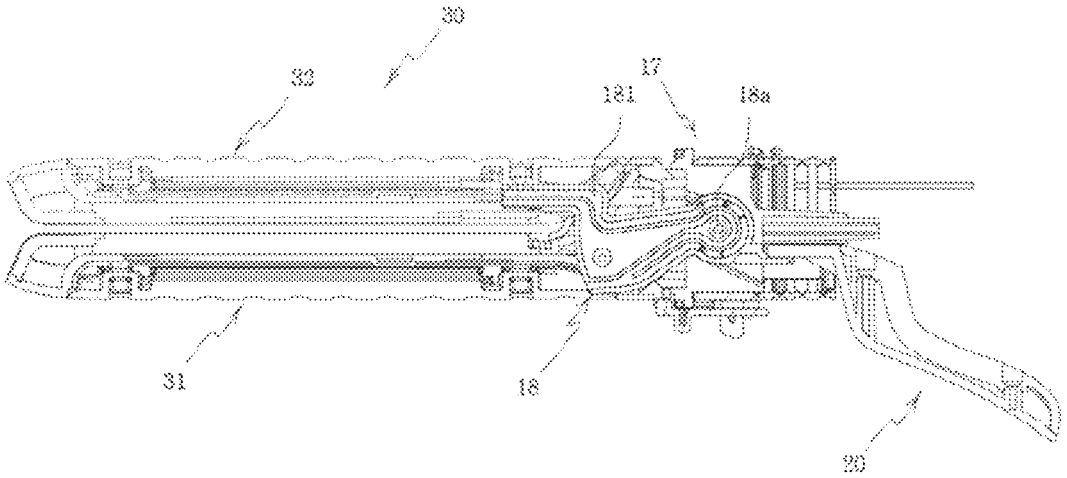
[FIG. 22]
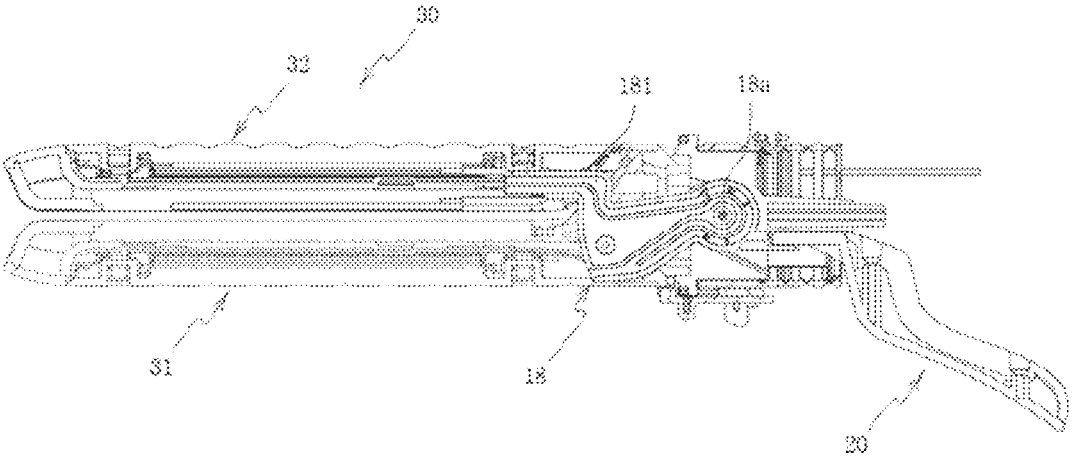

[FIG. 23]
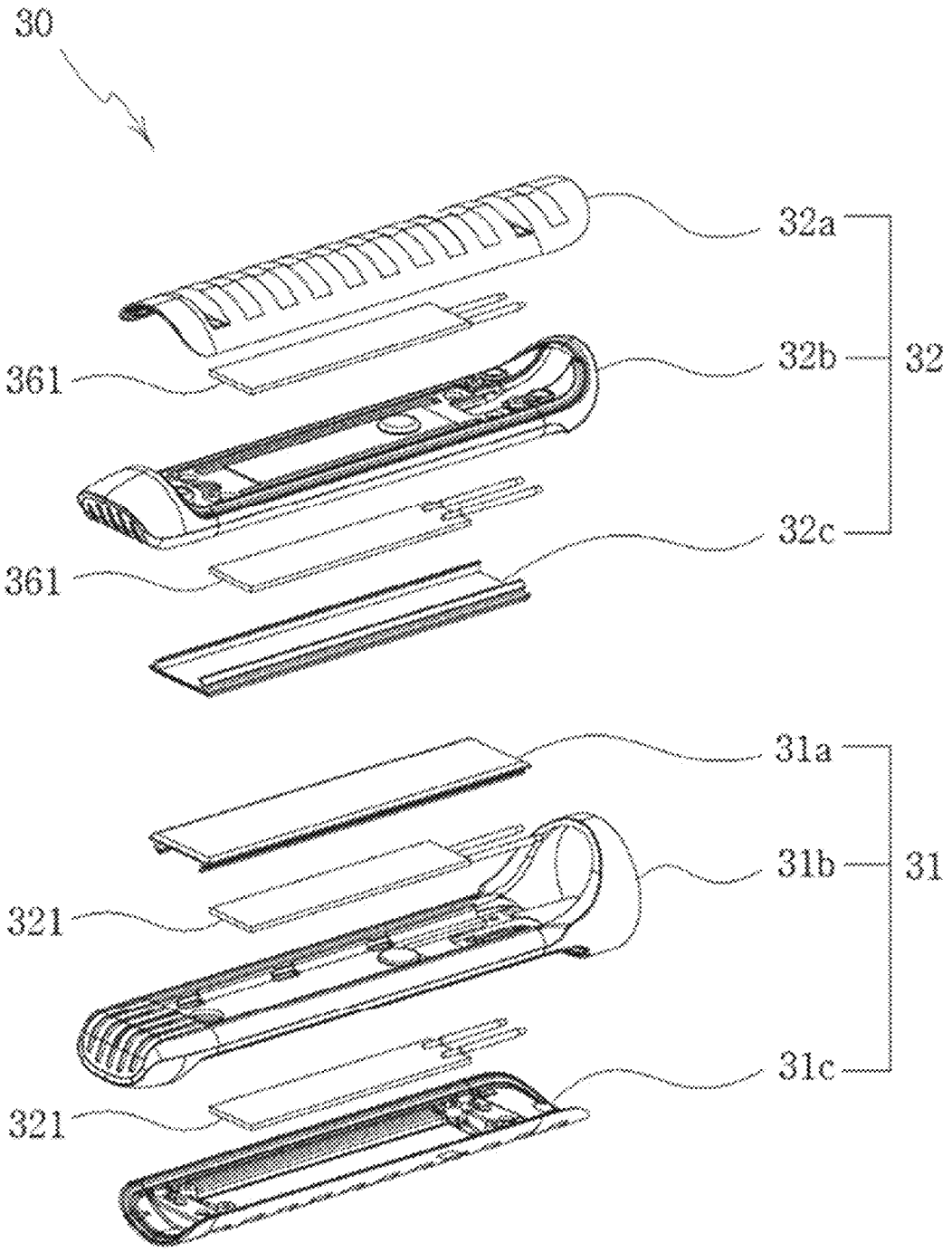

[FIG. 24]
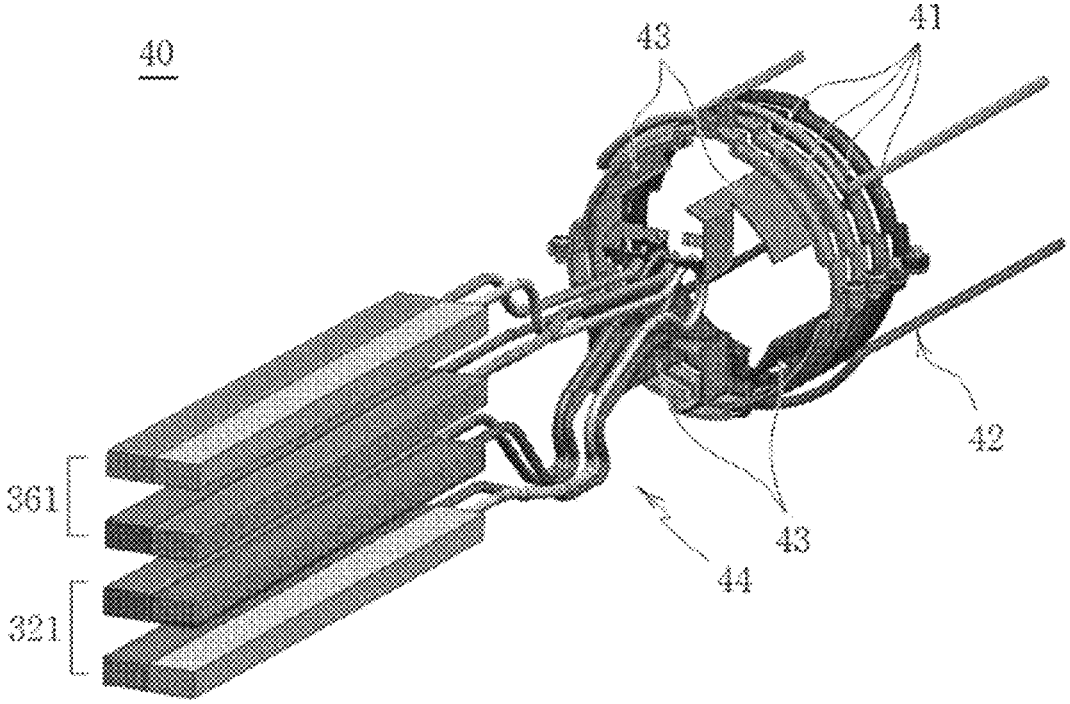

[FIG. 25]
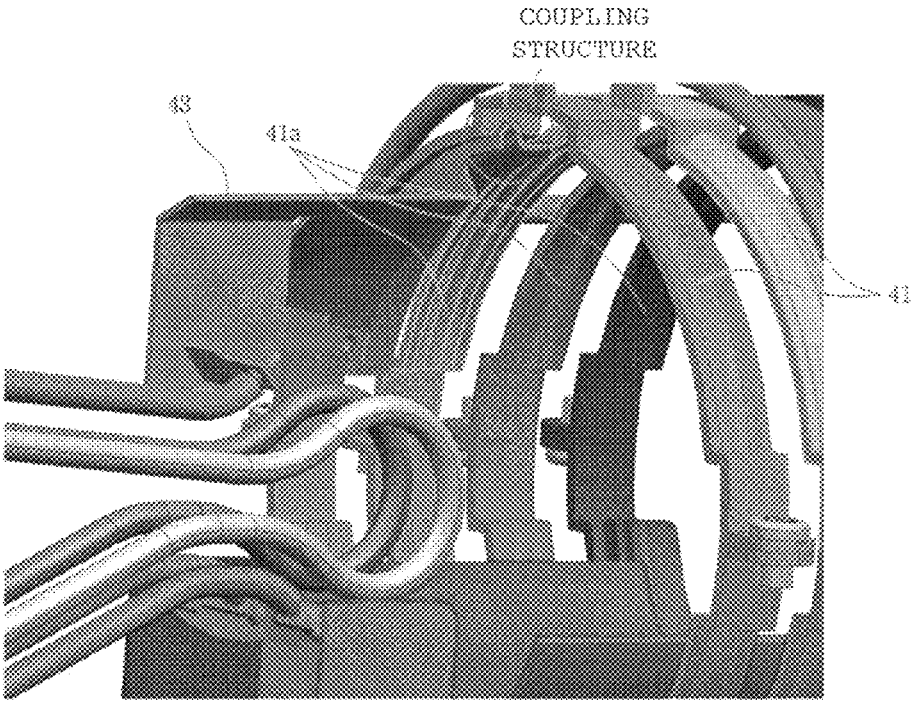
[FIG. 26]
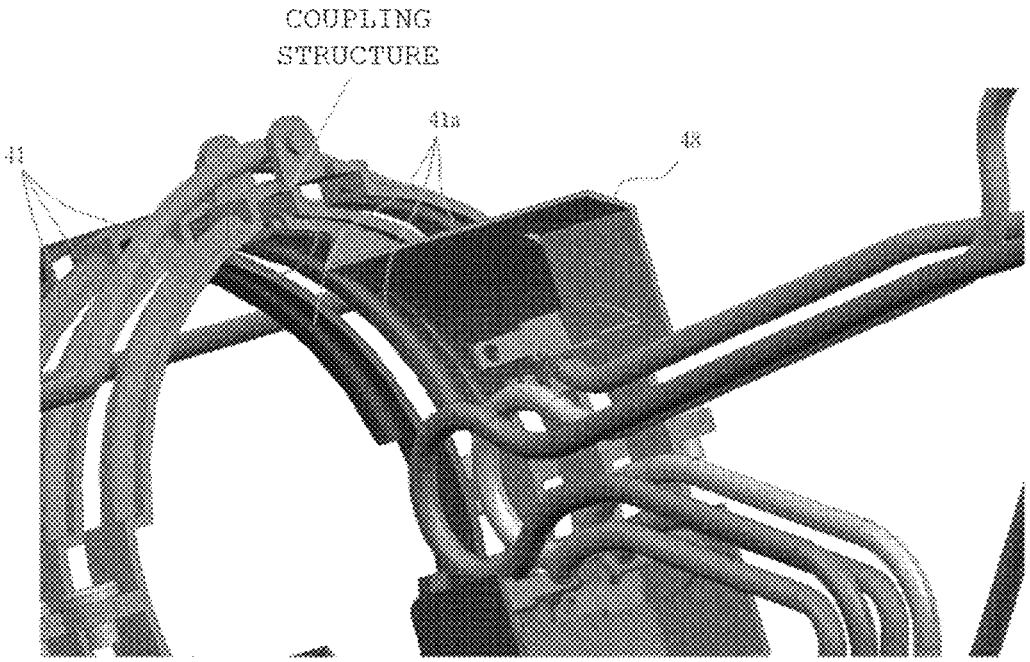

[FIG. 27]
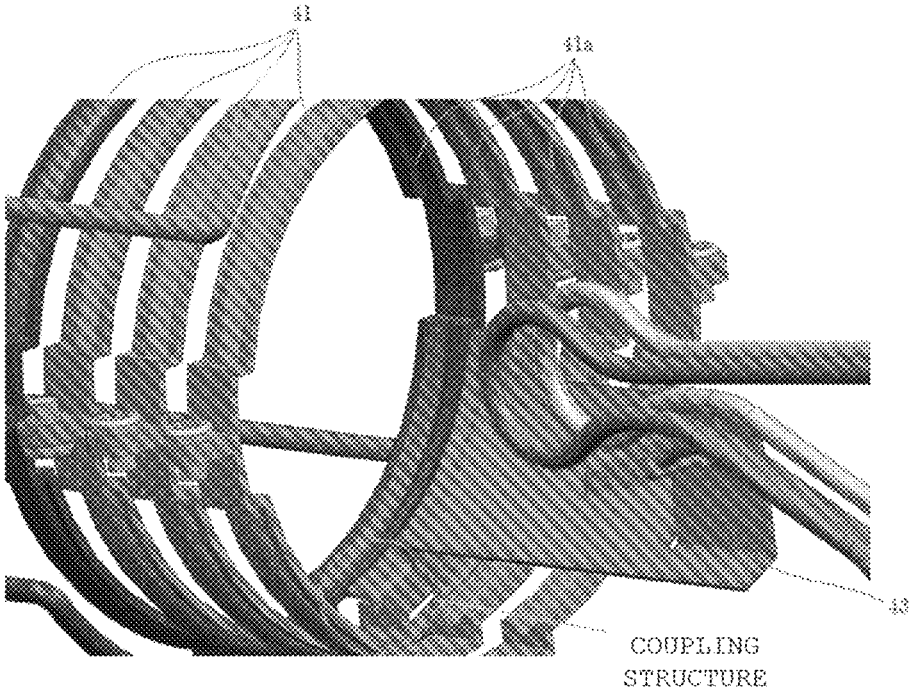
[FIG. 28]
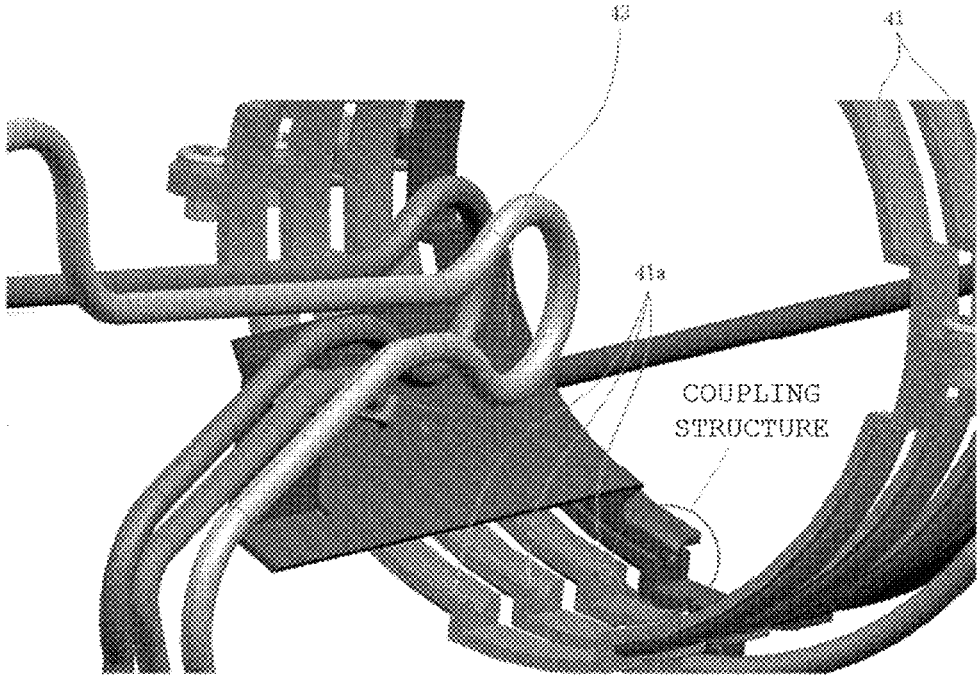

[FIG. 29]
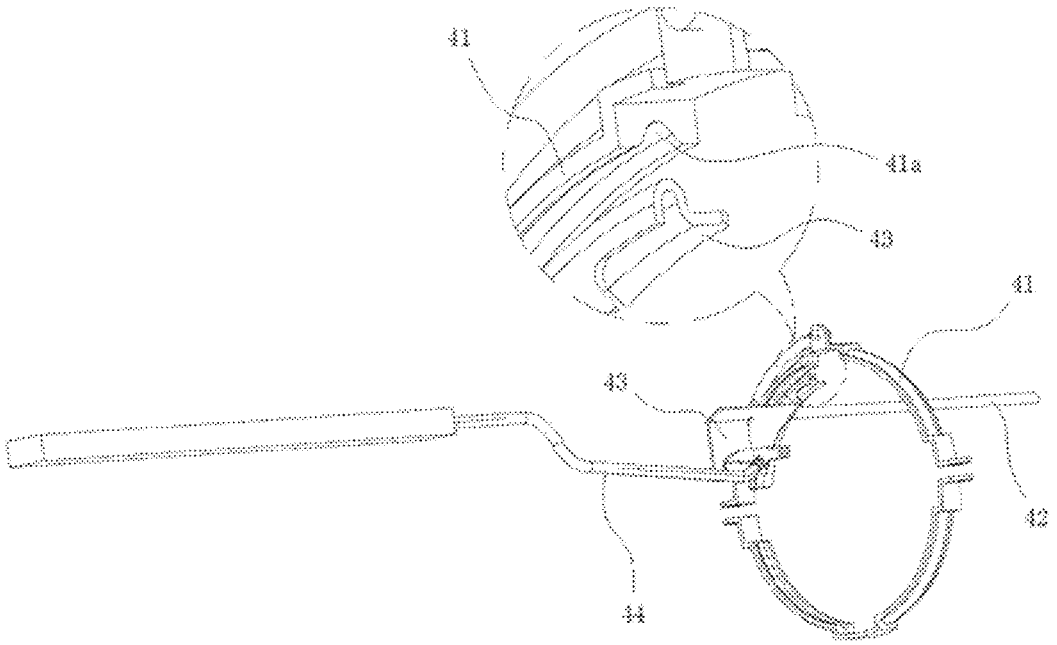

MULTIFUNCTIONAL HAIR-STYLING THERMAL TREATMENT BEAUTY DEVICE

FIELD OF INVENTION

The present invention relates to a multifunctional hair styling beauty electric heating device.

More particularly, the present invention relates to a multifunctional hair styling beauty electric heating device that easily styles the hair according to the situation by continuously rotating a hair styling part for gripping the hair clockwise or counterclockwise and opening an upper rotation body of the hair styling part in the state of gripping a grip body part and, configures a grounding continuity structure for continuously supplying power to a hot plate installed inside the hair styling part continuously rotated as described above, and thus a heating state of the hot plate is also continuously maintained due to heating action of current when the hair styling part is continuously rotated to more effectively style the hair in various forms by the hair styling part, and the hair is easily styled according to the situation and manipulation fatigue is also reduced, thereby improving user convenience.

BACKGROUND OF INVENTION

In general, a straightener for hair styling is a beauty device used to curl the hair using a heated hot plate, has an approximate shape of tongs, and is used to curl the hair in various shapes or straighten frizzy hair by curling long hair on the straightener or rotating the straightener appropriately.

In general, the hot plate of the straightener uses a heating wire that radiates heat as current flows, and the straightener uses a method of installing hot plates having a shape of tongs to face each other inside a body of the straightener and sweeping the straightener down while interposing the hair a user wants to style between the hot plates, and in this case, a degree of completion of curl and damage of the hair vary depending on the time when the hot plate is in contact with the hair and the pressure applied thereto. When the straightener is used, the heated hair is pulled from the beginning to the end of the air between the hot plates, and thus the hot plates tend to be adhered to the hair, and in this case, the fixation and the persistence of the set hair shape are improved, but there is a problem in that the hair is easily damaged while heat of the hot plate is strongly transferred to the hair. In addition, the straightener is sometimes used with a comb, and in this regard, the comb evens the hair entering the straightener and allows all possible hair passing through the straightener to curl or unfold in an appropriate direction, thereby increasing the degree of completion of curl. However, since both hands need to be used, it is not easy for an individual to simultaneously use the comb and the straightener while looking in a mirror alone. In this regard, according to the prior art related to a straightener, a comb is installed at one side of the straightener to allow the hair entering the hot plates to enter through the comb, but even if the straightener including the comb is used, the straightener needs to be strongly held to curl the hair well, and thus a problem in terms of damage to the hair due to this still exists. In general, the straightener is configured to rotatably install a pair of bodies via a hinge shaft on one side in a longitudinal direction, and in this case, when the straightener is used, the hand needs to keep gripping the bodies while keeping the bodies in close contact with each other, and also an operation of curling and pulling the hair needs to be repeatedly performed while holding the hand, and thus, there is an inconvenience in that considerable physical force is continuously required.

According to the background technology of the present invention, Korean Patent Publication No. 10-1788727 discloses a hair straightener. The straightener disclosed in the above Korean Patent Publication includes: a body formed like a column with a semicircular cross section and configured to receive external power; a heater connected to one end of the body and configured to receive power from the outside to generate heat; a presser having a shape corresponding to the body such that one surface thereof is in contact with the body and having one end connected to the other end of the body to rotate within a predetermined range; a pressurizer connected to the other end of the presser and configured to pressurize the hair of a user through an operation of the presser; and a guide part configured to guide the body and the heater connected thereto, and the presser and the pressurizer connected thereto so as not to be pushed when coupled, the heater includes an upper surface inclined to both sides based on a longitudinal direction and a lower surface formed like a curve, the pressurizer has a shape corresponding to the upper surface to be in close contact with the upper surface, the guide part includes a dome-shaped protrusion formed at an end of the body, connected to the heater, an insertion groove having a shape corresponding to the protrusion to allow the protrusion to be fixedly inserted thereinto at the position of the presser, corresponding to the protrusion, and a cushion part that protrudes at a position connected to the pressurizer inside the insertion groove and having a rounded upper surface, and the above Korean Patent Publication relates to a hair straightener in which the cushion part of the guide part is formed of a silicon material having heat resistance, and the body and one end of the presser are spaced apart from each other to prevent the hair of a user from being pinched when the protrusion is inserted into the insertion groove. The hair straightener of the above Korean Patent Publication has a function of increasing the volume of a root of the hair of the user to make the hair abundant by forming the upper surface of the heater to be inclined to both sides.

The present invention provides a hair styling beauty electric heating device for configuring grounding continuity to allow a hair styling part for gripping the hair to continuously rotate clockwise or counterclockwise and to continuously supply power to hot plates installed inside the hair styling part capable of continuously rotating, and thus, a heating state of the hot plate due to current heating is continuously maintained even during continuous rotation, thereby more effectively styling the hair in various ways by the hair styling part, the grounding continuity structure is not a point-to-point contact structure, but a continuous surface-to-surface structure, which is capable of generating heat at high temperature compared to a point-to-point contact structure, resulting in excellent thermal efficiency, and manipulation fatigue caused by hair styling is reduced by easily griping the hair between an upper rotation body and a lower fixation body by repeatedly performing a bending operation of the finger through the finger manipulator, and continuous rotation is also achieved by the lower fixation body, thereby easily styling the hair in various forms according to the situation. However, it is difficult to achieve such an effect from the art disclosed in the above patent.

SUMMARY OF INVENTION

Technical Problem to be Solved

A first objective of the present invention is to provide a multifunctional hair styling beauty electric heating device for improving manipulation convenience of hair styling by manipulating a control button provided on the grip body part using the thumb in the state in which user grips a grip body part to control power supply required to style the hair or manipulating the control button to rotate a hair styling part that grips the hair, for easily gripping the hair between an upper rotation body and a lower fixation body by repeatedly performing a bending operation of the index finger or the middle finger put on the finger manipulator to lower manipulation fatigue of hair styling, and for also easily styling the hair according to the situation.

A second objective of the present invention is to provide a multifunctional hair styling beauty electric heating device that continuously rotates a hair styling part for gripping the hair clockwise or counterclockwise, and configures a grounding continuity structure for continuously supplying power to a hot plate installed inside the hair styling part continuously rotated, thereby also continuously maintaining a heating state of the hot plate due to heating action of current when the hair styling part is continuously rotated to more effectively style the hair in various forms by the hair styling part, and in this case, the grounding continuity structure is not a point-to-point contact structure, but a continuous surface-to-surface structure, which is capable of generating heat at high temperature compared to a point-to-point contact structure, resulting in excellent thermal efficiency, and manipulation fatigue caused by hair styling is reduced by easily griping the hair between an upper rotation body and a lower fixation body by repeatedly performing a bending operation of the finger through the finger manipulator, and continuous rotation is also achieved by the lower fixation body, thereby easily styling the hair in various forms according to the situation.

Technical Solution

According to a first embodiment for achieving the above objective, a multifunctional hair styling beauty electric heating device includes: a grip body part including a guide piece formed along an inner circumference at one side in a longitudinal direction in a state in which a plurality of control buttons is formed on an upper surface of the grip body part;

a finger manipulator having one side in a longitudinal direction, rotatably installed inside the grip body part, and a remaining side in the longitudinal direction, exposed in a downward direction of the grip body part, and rotated through manipulation of a user finger;

a hair styling part including a lower rotation body having one side in a longitudinal direction, rotatably installed along the guide piece of the grip body part, and an upper rotation body rotatably installed upward and downward with respect to the lower rotation body, and configured to generate heat by power supplied from outside; and an up-down controller installed to be connected to the hair styling part and configured to rotate the upper rotation body upward and downward by the finger manipulator or to rotate the hair styling part by the control button.

According to a second embodiment for achieving the above objective, a multifunctional hair styling beauty electric heating device includes: a grip body part having an outer upper surface on which a control device configured to control temperature and rotation is formed and having an outer surface having a streamlined shape;

a finger manipulator exposed out of an outer lower side of the grip body part and configured to rotate the upper rotation body of a hair styling part upward and downward by manipulation of a user finger;

the hair styling part formed in a longitudinal direction at a front end of the grip body part and having a symmetrical structure in which a lower rotation body and an upper rotation body face each other in contact with each other, the lower rotation body being independently driven from the grip body part and continuously rotated clockwise or counterclockwise and the upper rotation body being independently driven from the grip body part and rotated upward and downward; and a power supply and heating part having grounding continuity whereby a conducting state is also maintained while the hair styling part is continuously rotated clockwise or counterclockwise and configured to maintain a heating state while the hair styling part is rotated due to continuous power supply to a hot plate installed in the hair styling part.

Effect of Invention

The multifunctional hair styling beauty electric heating device according to the present invention may have the following effects.

First, the upper rotation body may be rotated only through an operation of putting the finger on a finger manipulator and bending the finger instead of a conventional hand gripping operation when the hair is styled, thereby reducing manipulation fatigue caused by hair styling, and the hair may be curled by gripping and sweeping the hair down or rotating the hair styling part, thereby improving operability.

Second, the hair styling part for gripping the hair may be continuously rotated clockwise or counterclockwise and may have a grounding continuity structure for continuously supplying power to a hot plate installed inside the hair styling part that is continuously rotated, and thus a heating state of the hot plate due to heating action of current may also be maintained while the hair styling part is continuously rotated, thereby styling the hair in various forms by the hair styling part.

Third, due to a continuous rotation ground type conducting structure, a face-to-face ground method may be used instead of a conventional point-to-point ground method, and thus heat generation efficiency may be further increased compared with the conventional point-to-point ground method, and a continuously grounded state may be also be maintained while the hair styling part is rotated, thereby maximizing the functionality of the hair styling part.

BRIEF DESCRIPTION OF DRAWINGS

FIG. 1 is a state diagram showing the state of a beauty electric heating device with improved operability according to a first embodiment of the present invention.

FIG. 2 is a state diagram showing the state in which a guide piece is formed inside a grip body part of a beauty electric heating device according to the first embodiment of the present invention.

FIG. 3 is a state diagram showing the state of a finger manipulator of a beauty electric heating device according to the first embodiment of the present invention.

FIG. 4 is a state diagram showing the state of a hair styling part of a beauty electric heating device according to the first embodiment of the present invention.

FIG. 5 is a state diagram showing the state of an up-down controller of a beauty electric heating device according to the first embodiment of the present invention.

FIG. 6 is an enlarged state diagram of the state of a rotation manipulator of a beauty electric heating device according to the first embodiment of the present invention.

FIG. 7 is a state diagram showing a connection state of an up-down controller of a beauty electric heating device according to the first embodiment of the present invention.

FIG. 8 is an enlarged state diagram showing the states of a finger manipulator and an upward rotation guide part of a beauty electric heating device according to the first embodiment of the present invention.

FIG. 9 is a state diagram showing an installation state of a hair grip piece of a beauty electric heating device according to the first embodiment of the present invention.

FIG. 10 is an overall perspective view of a beauty electric heating device viewed from one side according to a second embodiment of the present invention.

FIG. 11 is an overall perspective view of a beauty electric heating device viewed from the other side according to the second embodiment of the present invention.

FIG. 12 is a perspective view showing a rotation state in a circular direction of a hair styling part included in a beauty electric heating device according to the second embodiment of the present invention.

FIG. 13 is a side view showing the state in which an upper rotation body included in a hair styling part of a beauty electric heating device is rotated upward by manipulation of a finger manipulator according to the second embodiment of the present invention.

FIG. 14 is a side view showing a procedure of rotating an upper rotation body included in a hair styling part of a beauty electric heating device upward by manipulation of a finger manipulator according to the second embodiment of the present invention.

FIG. 15 is an exploded cross-sectional view of a grip body part included in a beauty electric heating device according to the second embodiment of the present invention.

FIG. 16 is an exploded perspective view of a grip body part included in a beauty electric heating device according to the second embodiment of the present invention.

FIG. 17 is a perspective view of an upward rotation guide part included in a beauty electric heating device according to the second embodiment of the present invention.

FIG. 18 is an overall perspective view of a rotation manipulator according to the second embodiment of the present invention.

FIG. 19 is a perspective view showing a lock structure having a function of locking and releasing rotation of a rotation manipulator according to the second embodiment of the present invention.

FIG. 20 is a perspective view showing a coupling structure of an upward rotation guide part and a finger manipulator included in a beauty electric heating device according to the second embodiment of the present invention.

FIG. 21 is a side cross-sectional view showing a coupling relationship of a lower rotation body and a grip body part of a hair styling part included in a beauty electric heating device according to the second embodiment of the present invention.

FIG. 22 is a side cross-sectional view showing a coupling relationship of an upper rotation body and an upward rotation guide part of a hair styling part included in a beauty electric heating device according to the second embodiment of the present invention.

FIG. 23 is an overall exploded perspective view of a hair styling part included in a beauty electric heating device according to the second embodiment of the present invention.

FIG. 24 is an overall perspective view of a power supply and heating part included in a beauty electric heating device according to the second embodiment of the present invention.

FIG. 25 is a first partial enlarged view of a power supply and heating part included in a beauty electric heating device according to the present invention.

FIG. 26 is a second partial enlarged view of a power supply and heating part included in a beauty electric heating device according to the second embodiment of the present invention.

FIG. 27 is a third partial enlarged view of a power supply and heating part included in a beauty electric heating device according to the second embodiment of the present invention.

FIG. 28 is a fourth partial enlarged view of a power supply and heating part included in a beauty electric heating device according to the second embodiment of the present invention.

FIG. 29 is a perspective view showing a coupling relationship of a conducting rotation guide part and grounding rotation part included in a power supply and heating part of a beauty electric heating device according to the second embodiment of the present invention.

BEST MODE

A multifunctional hair styling beauty electric heating device having grounding continuity in a rotation state includes: a grip body part having an outer upper surface on which a control device configured to control temperature and rotation is formed and having an outer surface having a streamlined shape;

a finger manipulator exposed out of an outer lower side of the grip body part and configured to rotate the upper rotation body of a hair styling part upward and downward by manipulation of a user finger;

the hair styling part formed in a longitudinal direction at a front end of the grip body part and having a symmetrical structure in which a lower rotation body and an upper rotation body face each other in contact with each other, the lower rotation body being independently driven from the grip body part and continuously rotated clockwise or counterclockwise and the upper rotation body being independently driven from the grip body part and rotated upward and downward; and a power supply and heating part having grounding continuity whereby a conducting state is also maintained while the hair styling part is continuously rotated clockwise or counterclockwise and configured to maintain a heating state while the hair styling part is rotated due to continuous power supply to a hot plate installed in the hair styling part.

Mode for Invention

Hereinafter, a multifunctional hair styling beauty electric heating device according to the present invention will be described in detail with reference to the accompanying drawings. Prior thereto, in the following description of the present invention, a detailed description of known functions and configurations incorporated herein will be omitted when it may make the subject matter of the present disclosure unclear.

The terms used in the specification are defined in consideration of functions used in the present disclosure, and can be changed according to the intent or conventionally used methods of producers or manufacturers that manufacture products, the thicknesses or lines or the sizes of components in the following drawings may be exaggerated for convenience and clarity of explanation, embodiments described in the specification and components shown in the drawings are merely exemplary embodiments of the present disclosure and do not represent all technological features of the present disclosure, and thus, it is to be appreciated that various equivalents and modifications can be made to substitute the features when the application is filed.

In the specification, when it is described that a certain part is "connected" to another part, it should be understood that the certain part may be "directly connected" to another part or "indirectly connected" to another part via another part. Throughout this specification, unless explicitly described to the contrary, the word "comprise" and variations such as "comprises" or "comprising", will be understood to imply the inclusion of stated elements but not the exclusion of any other elements.

Also, as used herein, directional terms are used in reference to the orientation of the disclosed figure(s). The directional terminology is used for purposes of illustration and not limitation because components of embodiments of the present invention may be positioned in various orientations.

The multifunctional hair styling beauty electric heating device according to the present invention may be proposed in a first embodiment shown in FIGS. 1 to 9 and a second embodiment shown in FIGS. 10 to 29.

First, the multifunctional hair styling beauty electric heating device according to the first embodiment will be described.

Embodiment 1

FIG. 1 is a state diagram showing the state of a multifunctional hair styling beauty electric heating device with improved operability according to the present invention. FIG. 2 is a state diagram showing the state in which a guide piece is formed inside a grip body part according to the present invention. FIG. 3 is a state diagram showing the state of a finger manipulator according to the present invention. FIG. 4 is a state diagram showing the state of a hair styling part according to the present invention. FIG. 5 is a state diagram showing the state of an up-down controller according to the present invention. FIG. 6 is an enlarged state diagram of the state of a rotation manipulator according to the present invention. FIG. 7 is a state diagram showing a connection state of an up-down controller according to the present invention. FIG. 8 is an enlarged state diagram showing the states of a finger manipulator and an upward rotation guide part according to the present invention. FIG. 9 is a state diagram showing an installation state of a hair grip piece according to the present invention.

As shown in FIGS. 1 to 9, the multifunctional hair styling beauty electric heating device according to the present invention may include a grip body part 10 that has an upper surface on which a plurality of control buttons 110 is provided to be gripped by a user, a finger manipulator 20 installed in the grip body part 10 and rotating through manipulation of the user finger, a hair styling part 30 including a lower rotation body 31 and an upper rotation body 32 that are connected to the grip body part 10 and gripping the hair for styling the hair, and an up-down controller 400 configured to rotate the hair styling part 30 or to rotate the upper rotation body 32 upward.

That is, the multifunctional hair styling beauty electric heating device according to the present invention may easily curl the hair by rotating the hair styling part 30 through manipulation of the control button 110 in the state in which the grip body part 10 is gripped, and may easily straighten the hair by rotating the upper rotation body 32 upward through manipulation of the finger manipulator 20 to position the hair between the upper rotation body 32 and the lower rotation body 31 and then releasing manipulation of the finger manipulator 20 and folding the upper rotation body 32 toward the lower rotation body 31 to easily grip the hair during an operation of straightening the hair.

The grip body part 10 may be configured to receive external power and may include a guide piece 120 that is formed along an inner circumference at one side in a longitudinal direction in the state in which the plurality of control buttons 110 is formed on an upper surface of the grip body part 10. In this case, the guide piece 120 may include a first fastening piece 120*a* and a second fastening piece 120*b* that are spaced apart from each other at a predetermined interval along an inner circumference at one side in a longitudinal direction of the grip body part 10.

Here, the grip body part 10 may have an outer surface having a streamlined shape to increase gripping force of a user and may include a power line (not shown) to receive external power.

In this case, although the case in which the grip body part 10 receives external power through the power line has been described, the present invention is not limited thereto, and a separate battery accommodation part (not shown) may also be formed inside the grip body part 10.

The finger manipulator 20 may have one side in a longitudinal direction, which is rotatably installed inside the grip body part 10, and the other side in the longitudinal direction, which is exposed in a downward direction of the grip body part 10, and accordingly, the finger manipulator 20 may be rotated through manipulation of the user finger.

That is, when the hair is gripped between the lower rotation body 31 and the upper rotation body 32 of the hair styling part 30, the finger manipulator 20 may easily grip the hair and may position the hair between the lower rotation body 31 and the upper rotation body 32 by rotating the upper rotation body 32 upward only through a bending operation of the finger.

In this case, a separate elastic spring (not shown) for applying elastic force to the finger manipulator 20 may be installed in the grip body part 10, and in this case, when the upper rotation body 32 to be described below is opened through manipulation of the finger manipulator 20, the elastic spring may be compressed, and when manipulation of the finger manipulator 20 is released, the upper rotation body 32 is folded toward the lower rotation body 31 by elastic force of the elastic spring, and accordingly, the hair may be easily gripped by the upper and lower rotation bodies 32 and 31. The finger manipulator 20 will be described below in detail.

The hair styling part 30 may include the lower rotation body 31 having one side in a longitudinal direction, which is rotatably installed along the guide piece 120 of the grip body part 10, and the upper rotation body 32 that is rotatably installed upward and downward with respect to the lower rotation body 31, and thus may generate heat by power supplied from the outside to style the hair appropriate for the situation.

That is, the hair styling part 30 may be used to straighten the hair by sweeping down the hair while being gripped between the upper rotation body 32 and the lower rotation body 31 or to curl the hair by rotating the hair styling part 30 while being gripped between the upper rotation body 32 and the lower rotation body 31.

In this case, when the hair is gripped between the lower rotation body 31 and the upper rotation body 32, the upper rotation body 32 may be folded toward the lower rotation body 31 to easily grip the hair by rotating and opening the upper rotation body 32 upward through a bending operation of the finger caught in the finger manipulator 20 and then releasing the bending operation of the finger manipulator 20 in the state in which the hair is positioned between the lower rotation body 31 and the upper rotation body 32.

Here, the lower rotation body 31 may include a lower grip part 320 including a cap mount 322 at one side in a longitudinal direction thereof in the state in which a lower hot plate 321 for generating heat by power supplied from the outside is installed, a lower cover part 330 installed below the lower grip part 320, and a mounting cover 340 installed on the cap mount 322. In this case, a pair of long insert holes 323 may be formed in the cap mount 322, and an exposure hole 341 may be formed in the mounting cover 340.

The lower rotation body 31 may be rotatably installed by positioning the mounting cover 340 between the first and second fastening pieces 120*a* and 120*b* of the guide piece 120 in the state in which one side in a longitudinal direction of the lower rotation body 31 is positioned inside the grip body part 10.

The upper rotation body 32 may include an upper grip part 360 including an upper hot plate 361 mounted thereon to generate heat by power supplied from the outside, and an upper cover part 370 mounted above the upper grip part 360.

The up-down controller 400 may be installed to be connected to the hair styling part 30 and may rotate the upper rotation body 32 upward and downward by the finger manipulator 20 or may rotate the hair styling part 30 by the control button 110.

That is, when the finger manipulator 20 is manipulated, the upper rotation body 32 may be opened by the up-down controller 400, and when the control button 110 is manipulated, the hair styling part 30 may be rotated by the up-down controller 400, and accordingly, the hair may be curled.

Here, the up-down controller 400 according to an embodiment will now be described. The up-down controller 400 may include a driving motor 15 installed inside the grip body part 10 and driven through manipulation of the control button 110, a rotation manipulator 420 that is connected to a driveshaft of the driving motor 15 to rotate the hair styling part 30 in that state of being installed at one side in a longitudinal direction of the lower rotation body 31, and an upward rotation guide part 460 that is formed at one side in a longitudinal direction of the upper rotation body 32 to be connected to the rotation manipulator 420 and to open the upper rotation body 32 when the finger manipulator 20 is manipulated.

In this case, the rotation manipulator 420 may include a close mounting part 430 installed at one side in a longitudinal direction of the lower rotation body 31 and including a position mount hole 431 formed therein to slidably insert the upward rotation guide part 460 thereinto, a pair of rotation guide pieces 440 that extends toward the driving motor 15 from one side surface of the close mounting part 430 and to which one side in a longitudinal direction of the upward rotation guide part 460 is coupled via a hinge shaft 441, and a shaft rotation connector 450 that extends toward the driving motor 15 from one side of the close mounting part 430 while being positioned between the rotation guide pieces 440 and connected to a driveshaft of the driving motor 15.

Here, the rotation manipulator 420 may be installed between the cap mount 322 and the mounting cover 340, and the shaft rotation connector 450 may protrude toward the driving motor 15 through the exposure hole 341 of the mounting cover 340.

The upward rotation guide part 460 may include an extension guide plate 461 that extends from one side in a longitudinal direction of the upper rotation body 32 and is slidably inserted into the position mount hole 431, and a receiver 462 that is formed at an end of the extension guide plate 461, is coupled to the rotation guide pieces 440 via the hinge shaft 441, and has a lower side in a longitudinal direction, which extends toward an internal lower side of the grip body part 10, that is, one side in a longitudinal direction of the finger manipulator 20.

Here, the position mount hole 431 may be connected to the long insert holes 323 of the cap mount 322, and thus the extension guide plate 461 may be slidably inserted into the long insert holes 323 and the position mount hole 431.

An operating state of the up-down controller as configured above will now be described. First, when the upper rotation body 32 is rotated upward to be opened, if the finger manipulator 20 is manipulated, one side of the finger manipulator 20 may pressurize the receiver 462 of the upward rotation guide part 460, and thus, the upper rotation body 32 may be rotated upward based on the hinge shaft 441 and may be opened.

Then, when manipulation of the finger manipulator 20 is released, the upper rotation body 32 may be folded toward the lower rotation body 31 by elastic force of the elastic spring to easily grip the hair.

In this case, it is noted that the elastic spring is installed at a rotation shaft of the finger manipulator 20 or is installed at the hinge shaft 441 of the rotation manipulator 420.

In this state, in order to straighten the hair, a worker may straighten the hair by sweeping down the hair in the state of being gripped between the upper and lower rotation bodies 32 and 31, and in order to curl the hair, the worker may manipulate the control button 110 to drive the driving motor 15 and to rotate the rotation manipulator 420, and thus, the upper and lower rotation bodies 32 and 31 connected to the rotation manipulator 420 may be rotated clockwise or counterclockwise to curl the hair.

The finger manipulator 20 may rotate the upper rotation body 32 upward to open the same, and according to an embodiment, the finger manipulator 20 may include a grip body part 210 rotatably installed inside the grip body part 10, a supporter 220 formed above the grip body part 210, and an extension pressurizer 230 that protrudes from the supporter 220 and rotates the upper rotation body 32 upward based on the hinge shaft 441 to open the upper rotation body 32 by pressurizing the receiver 462 when the grip body part 210 is manipulated.

In this case, a concave groove 221 may be formed on an upper surface of the supporter 220, and the driving motor 15 may be positioned above the concave groove 221.

A separate rotation limiting member 411 installed at one side of the driving motor 15 and limiting rotation of the finger manipulator 20 may be installed inside the grip body part 10.

The multifunctional hair styling beauty electric heating device according to the present invention may include a hair grip piece 500 for gripping the hair when the hair styling part 30 is rotated in order to curl the hair in the state of being gripped by the hair styling part 30.

That is, the hair grip piece 500 may have one side in a longitudinal direction, connected to the grip body part 10, and in this state, may be spaced apart from the hair styling part 30 at a predetermined interval and may guide the hair styling part 30 to grip the hair when the hair styling part 30 is rotated.

In this case, the hair grip piece 500 may be configured to have an arc-shaped widthwise cross-section and may be spaced apart from the lower rotation body 31 at a predetermined interval.

The hair grip piece 500 may be detachably installed on the grip body part 10 in order to appropriately use the hair grip piece 500 according to the situation by using the hair grip piece 500 when the hair is to be curled and separating the hair grip piece 500 from the grip body part 10 and storing the hair grip piece 500 when the hair is to be straightened.

As such, the multifunctional hair styling beauty electric heating device according to Embodiment 1 of the present invention may perform both operations of straightening and curling the hair through one device, thereby improving usability, and the upper rotation body may be rotated upward by manipulation of the finger or the hair styling part may be rotated clockwise or counterclockwise, thereby improving operability.

Embodiment 2

As shown in FIGS. 10 to 14,

The multifunctional hair styling beauty electric heating device according to Embodiment 2 of the present invention may have grounding continuity in a rotation state.

The multifunctional hair styling beauty electric heating device may include: the grip body part 10 having an outer upper surface on which a control device for controlling temperature and rotation is formed and having an outer surface in a streamlined shape;

the finger manipulator 20 exposed out of an outer lower side of the grip body part 10 and configured to rotate the upper rotation body of the hair styling part upward and downward by manipulation of the user finger;

the hair styling part 30 formed in a longitudinal direction at a front end of the grip body part 10 and having a symmetrical structure in which the lower rotation body 31 and the upper rotation body 32 face each other in contact with each other, the lower rotation body 31 being independently driven from the grip body part 10 and continuously rotated clockwise or counterclockwise and the upper rotation body 32 being independently driven from the grip body part 10 and rotated upward and downward; and a power supply and heating part 40 having grounding continuity whereby a conducting state is also maintained while the hair styling part 30 is continuously rotated clockwise or counterclockwise and for also maintaining a heating state while the hair styling part 30 is rotated because it is possible to continuously supply power to a hot plate mounted on the hair styling part 30.

As shown in FIGS. 12 to 14, the hair styling part 30 according to the present invention may be installed at the front end of the grip body part 10 in a longitudinal direction to achieve a physical coupling structure, but the hair styling part 30 may be separately operated from the grip body part 10 and may be independently rotated therefrom.

The lower rotation body 31 included in the hair styling part 30 may be continuously rotated clockwise or counterclockwise. That is, a user may continuously rotate the lower rotation body 31 for a desired time or in a desired direction through the control device.

The upper rotation body 32 included in the hair styling part 30 may be rotated upward to be opened. In this case, the upper rotation body 32 may be rotated upward by manipulation of the user finger through the finger manipulator 20.

According to the present invention, current may also be continuously and seamlessly supplied to the hot plate while the hair styling part 30 is rotated, and thus the hot plate may be continuously heated due to heating action of current, and the hair styling part 30 may be entirely heated through heating by the hot plate, thereby easily styling the hair.

Components included in a hair styling beauty electric heating device 1 will be described below in detail.

As shown in FIGS. 10, 15, and 16, the grip body part 10 may have an outer upper surface on which a control device for controlling temperature and rotation is formed and may have an outer surface having a streamlined shape.

The control device may include a first controller 11 including a power supply ON/OFF button 111 and a temperature control button 112 that are formed on the outer upper surface of the grip body part 10, and a second controller 12 including a rotation direction control button 121 formed on the outer upper surface spaced apart from the first controller 11 by a predetermined distance and rotating the hair styling part 30 clockwise or counterclockwise, and an initialization button 122 for restoring the hair styling part 30 to an initial state thereof prior to rotation.

The first controller 11 may be electrically connected to a main board 13 that is installed in an inner upper part of the grip body part 10 to receive external power and may control the temperature of heat emitted through the hot plate including the plurality of lower hot plates 321 and upper hot plates 361 installed in the hair styling part 30 through a controller installed in the main board 13.

In this case, the heating temperature of the lower hot plate 321 of the lower rotation body 31 and the upper hot plate 361 of the upper rotation body 32 may be manipulated differently through the controller.

The grip body part 10 may have various outer appearances, but may be formed in a streamlined shape in order to increase gripping force of a user.

A power line 14 may be provided to receive external power. In addition to the method of receiving external power through the power line 14, a method of forming a separate battery accommodation part (not shown) inside the grip body part 10 may also be used.

A rotation driver that is driven by manipulation of the second controller 12 may be installed at an inner central part in a longitudinal direction of the grip body part 10.

The rotation driver may include the driving motor 15 electrically connected to the second controller 12, a driveshaft 16 connected to the driving motor 15, and a rotation manipulator 17 connected to the driveshaft 16.

When the driving motor 15 of the rotation driver is operated through manipulation of a button of the second controller 12, rotation power of the driving motor 15 may be transferred to the driveshaft 16 to rotate the rotation manipulator 17 having a coupling structure with the driveshaft 16.

Thus, the lower rotation body 31 of the hair styling part 30 having the physical coupling structure with the rotation manipulator 17 may be continuously rotated clockwise or counterclockwise or may be restored to an initial state thereof prior to rotation.

As shown in FIGS. 15 and 16, an upward rotation guide part 18 may be coupled to an inner central part of the rotation manipulator 17.

A front end of the upward rotation guide part 18 may be physically coupled to the upper rotation body 32 of the hair styling part 30, and a rear end may be formed in contact with one end of the finger manipulator 20.

A plurality of hollow paths 181 may be formed inside the upward rotation guide part 18. The path 181 may be a space in which a second power supply line 44 is positioned.

The upward rotation guide part 18 may be installed between the upper rotation body 32 and the finger manipulator 20, and when the finger manipulator 20 is pulled by manipulation of the user finger, the rear end of the upward rotation guide part 18 in contact with the finger manipulator 20 may be pressed downward, and in this case, the upper rotation body 32 that is physically coupled to the front end of the upward rotation guide part 18 may be smoothly rotated upward. The upward rotation guide part 18 may be rotated upward using a rotation shaft 18a formed at one side thereof as the center of rotation.

In contrast, when manipulation for pulling the finger manipulator 20 is released, the upward rotation guide part 18 may be restored to an original state thereof as force for pressing the rear end of the upward rotation guide part 18 downward is released.

As shown in FIG. 17, an elastic spring 181*a* may be installed at the rotation shaft 18a of the upward rotation guide part 18. When manipulation for pulling the finger manipulator 20 is released, the upward rotation guide part 18 may be restored to an initial positional state due to an action of elastic force of the elastic spring 181*a*.

As shown in FIG. 18, a circular rotating body 171 forming a gear structure may be formed along an edge of the front end of the rotation manipulator 17.

As shown in FIG. 19, a lock button 172 having a rotation lock function for blocking rotational driving of the lower rotation body 31 may be formed on an outer lower surface of the grip body part 10 as necessary.

As shown in FIG. 19, the lock button 172 may be integrally formed with a stop protrusion 172*a* protruding in an inward direction of the grip body part 10.

When locking is required, the user may push the lock button 172 toward the circular rotating body 171 forming the gear structure to insert the stop protrusion 172*a* into a groove 171*a* of the gear structure formed along an edge of the circular rotating body 171, thereby preventing the circular rotating body 171 from being rotated.

In contrast, in order to release a rotation locking state of the lower rotation body 31, the user may manipulate the lock button 172 to remove the stop protrusion 172*a* of the lock button 172 from the groove 171*a*, thereby releasing the rotation locking state of the lower rotation body 31.

As shown in FIGS. 14 to 16, and 20, the finger manipulator 20 may be exposed out of the outer lower side of the grip body part 10 to form a trigger structure.

The user may easily grip the hair between the upper rotation body 32 and the lower rotation body 31 by repeatedly performing a bending operation of the finger through the finger manipulator 20 exposed out of the outer lower side, thereby reducing manipulation fatigue caused by hair styling.

Due to the ease of manipulation, the hair may be easily styled according to the situation.

By manipulation for pulling the finger manipulator 20, the upper rotation body 32 may be unfolded to be opened while being rotated upward from the lower rotation body 31, and when the pulling manipulation is released, the upper rotation body 32 may be closed while being restored to an original state thereof.

As described above, when the finger manipulator 20 is manipulated as if pulling a trigger by bending the user finger, the finger manipulator 20 may press the rear end of the upward rotation guide part 18 downward, and the front end of the upward rotation guide part 18 may be smoothly rotated upward using the rotation shaft 18a as a rotation shaft.

When the front end of the upward rotation guide part 18 is rotated upward, the upper rotation body 32 of the hair styling part 30 physically coupled to the front end may be smoothly rotated upward.

As shown in FIGS. 12 and 13, the hair styling part 30 may include the lower rotation body 31 capable of being continuously rotated within a manipulation range desired by the user while drawing an imaginary circle clockwise or counterclockwise, and the upper rotation body 32 installed with a symmetrical structure with respect to the lower rotation body 31 to rotate upward and downward.

As shown in FIGS. 19 and 21, the lower rotation body 31 may be physically coupled to the rotation manipulator 17.

As shown in FIGS. 19 and 21, the rotation manipulator 17 may be connected to the driveshaft 16 and the driving motor 15 to form a straight structure, and the driveshaft 16 and the rotation manipulator 17 may be rotated by rotation power of the driving motor 15. Rotation driving of the rotation manipulator 17 may be transferred to the lower rotation body 31 physically coupled thereto to rotate the lower rotation body 31 clockwise or counterclockwise.

As shown in FIG. 22, the upper rotation body 32 may be physically coupled to the front end of the upward rotation guide part 18.

The upper rotation body 32 may be rotated upward, which is the same as in the above description.

FIG. 23 is a full exploded perspective view of the hair styling part 30.

As shown in FIG. 23, the lower rotation body 31 may configure a stack structure including a lower hair grip part 31*a*, a lower body part 31*b*, and a lower cover part 31*c*. The pair of lower hot plates 321 may be installed between the lower hair grip part 31*a* and the lower body part 31*b* and between the lower body part 31*b* and the lower cover part 31*c*.

The pair of lower hot plates 321 may be mounted on the lower rotation body 31 to dissipate heat in both of a direction toward the lower hair grip part 31*a* and a direction toward the lower cover part 31*c*, thereby dissipating heat over an entire surface of the lower rotation body 31.

The upper rotation body 32 may configure a stack structure including an upper hair grip part 32*a*, an upper body part 32*b*, and an upper cover part 32*c*. The pair of upper hot plates 361 may be installed between the upper hair grip part 32*a* and the upper body part 32*b* and between the upper body part 32*b* and the upper cover part 32*c*.

The pair of upper hot plates 361 may be mounted on the upper rotation body 32 to dissipate heat in both directions of a direction toward the upper hair grip part 32*a* and a direction toward the upper cover part 32*c*, thereby dissipating heat over an entire surface of the upper rotation body 32.

The temperature of heat dissipated through the lower rotation body 31 and the temperature of heat dissipated through the upper rotation body 32 may be controlled to be the same or different from each other. Such control may be performed by a controller installed in the aforementioned main board 13.

Due to the rotation function and the heating function, the hair may be variously and simply styled using the hair styling part 30.

The power supply and heating part 40 may be continuously rotated clockwise or counterclockwise with the hair styling part 30 while being physically coupled to the grip body part 10, and thus may also continuously maintain a conducting state while the hair styling part 30 is continuously rotated.

That is, the power supply and heating part 40 may have grounding continuity whereby a conducting state is also maintained while the hair styling part 30 is continuously rotated clockwise or counterclockwise, and thus, may also maintain a heating state by the hot plate installed in the hair styling part 30 while the hair styling part 30 is rotated.

Due to a conducting structure having grounding continuity, the hair styling part 30 may easily, conveniently, and effectively style the hair in various forms.

As shown in FIGS. 24 and 29, the power supply and heating part 40 may include a conducting rotation guide part 41 that forms a non-rotating circular ring structure formed of metal and includes a rotation grounding guide groove 41*a* formed along an inner circumferential surface of the circular ring structure, a plurality of first power supply lines 42 connected to one side of an outer circumferential surface of the circular ring structure and configured to supply external power, a grounding rotation part 43 capable of being infinitely rotated clockwise or counterclockwise along the rotation grounding guide groove 41*a* while being coupled to the rotation grounding guide groove 41*a* of the conducting rotation guide part 41 to maintain a grounded state, the second power supply line 44 having one side electrically connected to the hot plate installed in the lower rotation body 31 and the upper rotation body 32 of the hair styling part 30 and the other side electrically connected to the grounding rotation part 43 to supply external power supplied through the first power supply line 42 to the hot plate, and the hot plate for dissipating heat using external power supplied through the second power supply line 44.

As shown in FIGS. 24, and 25 to 29,

The power supply and heating part 40 may include a non-rotating part and a rotating part.

That is, the power supply and heating part 40 may include the non-rotating part including the conducting rotation guide part 41 fixedly installed inside the grip body part 10, and the plurality of first power supply lines 42 connected to one side of the outer circumferential surface of a circular ring structure of the conducting rotation guide part 41 and configured to supply external power; and the rotating part including the grounding rotation part 43 coupled to the rotation grounding guide groove 41a of the conducting rotation guide part 41 and rotated along the rotation grounding guide groove 41*a* while maintaining the face-to-face grounded state, the second power supply line 44 having one side electrically connected to the hot plate installed in the lower rotation body 31 and the upper rotation body 32 of the hair styling part 30 and the other side electrically connected to the grounding rotation part 43 to supply external power supplied through the first power supply line 42 to the hot plate, and the hot plate for dissipating heat due to heating action of current supplied through the second power supply line 44, and being capable of being continuously rotated clockwise or counterclockwise.

That is, the external power supplied through the first power supply line 42 may be provided to the grounding rotation part 43, the second power supply line 44, and the hot plate through the conducting rotation guide part 41, and thus the hot plate may be heated due to heating action of current.

The hot plate installed inside the hair styling part 30, the second power supply line 44 having one side electrically connected to the hot plate and the other side connected to the grounding rotation part 43, and the grounding rotation part 43 coupled to the rotation grounding guide groove 41*a* formed on the inner circumferential surface of the circular ring structure configuring the conducting rotation guide part 41 may be the rotating part, and thus may be rotated in the same way depending on the rotation direction and speed of the hair styling part 30.

In this case, the conducting rotation guide part 41 may be a structure that is fixedly installed inside the grip body part 10 and may not be rotated. That is, the conducting rotation guide part 41 may be the non-rotating part.

According to the present invention, the grounding rotation part 43 of the rotating part and the conducting rotation guide part 41 of the non-rotating part may be coupled to each other, and thus the face-to-face grounded state may also be maintained to achieve conduction when the hair styling part 30 is continuously rotated.

As shown in FIG. 29, the coupling structure may be a structure in which the grounding rotation part 43 is coupled to the rotation grounding guide groove 41*a* formed along the inner circumferential surface of the circular ring structure of the conducting rotation guide part 41. Due to the coupling structure, when the grounding rotation part 43 is continuously rotated along the rotation grounding guide groove 41*a*, the face-to-face grounded state may also be continuously maintained.

Due to the coupling structure, even if the hair styling part 30 is continuously rotated clockwise or counterclockwise, the grounded state may be continuously maintained, and a heating state of the hot plate due to the grounding continuity may also be maintained when the hair styling part 30 is rotated.

The plurality of conducting rotation guide parts 41 may be formed to maintain the 1:1 grounded state with the grounding rotation parts 43 through the rotation grounding guide groove 41*a*. As a detailed example, as shown in FIGS. 16 to 28, the number of the grounding rotation parts 43 may be four, and the number of circular ring structures, a grounded state of which is independently maintained from the grounding rotation part 43, may be at least 4.

The number of the grounding rotation parts 43 and the number of the circular ring structures configuring the conducting rotation guide part 41 may be a plural number corresponding to the number of hot plates mounted as multiple layers in the hair styling part 30.

Although specific embodiments of the present invention have been described in detail as described above, various modifications may be made to those skilled in the art without departing from the scope of the present invention. Therefore, the scope of the present invention is not limited to the above-described embodiments, and should be defined by not only the claims described below but also the claims and equivalents.

INDUSTRIAL AVAILABILITY

The present invention may be industrially available by proposing a multifunctional hair styling beauty electric heating device that easily styles the hair according to the situation by continuously rotating a hair styling part for gripping the hair clockwise or counterclockwise and opening an upper rotation body of the hair styling part in the state of gripping a grip body part and configures a grounding continuity structure for continuously supplying power to a hot plate installed inside the hair styling part continuously rotated as described above, and thus a heating state of the hot plate is also continuously maintained due to heating action of current when the hair styling part is continuously rotated to more effectively style the hair in various forms by the hair styling part, and the hair is easily styled according to the situation and manipulation fatigue is also reduced, thereby improving user convenience.

The invention claimed is:

1. The multifunctional hair styling beauty electric heating device comprising:

a grip body part including a guide piece formed along an inner circumference at one side in a longitudinal direction in a state in which a plurality of control buttons is formed on an upper surface of the grip body part;

a finger manipulator having one side in a longitudinal direction, rotatably installed inside the grip body part, and a remaining side in the longitudinal direction, exposed in a downward direction of the grip body part, and rotated through manipulation of a user finger;

a hair styling part including a lower rotation body having one side in a longitudinal direction, rotatably installed along the guide piece of the grip body part, and an upper rotation body rotatably installed upward and downward with respect to the lower rotation body, and configured to generate heat by power supplied from outside; and an up-down controller installed to be connected to the hair styling part and configured to rotate the upper rotation body upward and downward by the finger manipulator or to rotate the hair styling part by the control button wherein the up-down controller includes:

a driving motor installed inside the grip body part and driven through manipulation of the control button;

a rotation manipulator connected to a driveshaft of the driving motor to rotate the hair styling part in a state of being installed at one side in a longitudinal direction of the lower rotation body; and an upward rotation guide part formed at one side in a longitudinal direction of the upper rotation body to be connected to the rotation manipulator and to open the upper rotation body when the finger manipulator is manipulated, wherein the rotation manipulator further comprises:

a close mounting part installed at one side in a longitudinal direction of the lower rotation body and including a position mount hole formed therein to slidably insert the upward rotation guide part thereinto;

a pair of rotation guide pieces that extends toward the driving motor from one side surface of the close mounting part and to which one side in a longitudinal direction of the upward rotation guide part is coupled via a hinge shaft; and a shaft rotation connector that extends toward the driving motor from one side of the close mounting part while being positioned between the rotation guide pieces and connected to the driveshaft of the driving motor.

2. The multifunctional hair styling beauty electric heating device according to claim 1, wherein the upward rotation guide part includes:

an extension guide plate that extends from at one side in a longitudinal direction of the upper rotation body and is slidably inserted into the position mount hole; and a receiver that is formed at an end of the extension guide plate, is coupled to the rotation guide pieces via the hinge shaft, and has a lower side in a longitudinal direction, which extends toward an internal lower side of the grip body part.

3. The multifunctional hair styling beauty electric heating device according to claim 2, wherein the finger manipulator includes:

a grip body part rotatably installed inside the grip body part;

a supporter formed above the grip body part; and an extension pressurizer protruding from the supporter and configured to rotate the upper rotation body by pressurizing the receiver when the grip body part is manipulated.

4. The multifunctional hair styling beauty electric heating device according to any one of claims 1 to 2, further comprising:

a hair grip piece spaced apart from the hair styling part by a predetermined interval while being connected to the grip body part and configured to guide the hair styling part to grip hair when the hair styling part is rotated.

5. The multifunctional hair styling beauty electric heating device according to claim 4, wherein the hair grip piece is detachably installed on the grip body part.

6. A multifunctional hair styling beauty electric heating device having grounding continuity in a rotation state, comprising:

a grip body part having an outer upper surface on which a control device configured to control temperature and rotation is formed and having an outer surface having a streamlined shape;

a finger manipulator exposed out of an outer lower side of the grip body part and configured to rotate the upper rotation body of a hair styling part upward and downward by manipulation of a user finger;

the hair styling part formed in a longitudinal direction at a front end of the grip body part and having a symmetrical structure in which a lower rotation body and an upper rotation body face each other in contact with each other, the lower rotation body being independently driven from the grip body part and continuously rotated clockwise or counterclockwise and the upper rotation body being independently driven from the grip body part and rotated upward and downward; and a power supply and heating part having grounding continuity whereby a conducting state is also maintained while the hair styling part is continuously rotated clockwise or counterclockwise and configured to maintain a heating state while the hair styling part is rotated due to continuous power supply to a hot plate installed in the hair styling part.

7. The multifunctional hair styling beauty electric heating device having grounding continuity in a rotation state according to claim 6, wherein the power supply and heating part includes:

a non-rotating conducting rotation guide part forming a plurality of metal circular ring structures, and including a rotation grounding guide groove formed along an inner circumferential surface of the circular ring structure;

a first power supply line connected to one side of an outer circumferential surface of each of the plurality of circular ring structures and configured to supply external power;

a grounding rotation part capable of being continuously rotated clockwise or counterclockwise along the rotation grounding guide groove while being coupled to the rotation grounding guide groove of the conducting rotation guide part to maintain a face-to-face grounded state;

a second power supply line having one side electrically connected to a hot plate installed in the hair styling part and a remaining side electrically connected to the grounding rotation part to supply external power supplied through the first power supply line to the hot plate; and the hot plate configured to dissipate heat using external power supplied through the second power supply line.

8. The multifunctional hair styling beauty electric heating device having grounding continuity in a rotation state according to claim 6, wherein the power supply and heating part includes:

a non-rotating part including a conducting rotation guide part fixedly installed inside the grip body part and a plurality of first power supply lines connected to one side of an outer circumferential surface of a circular ring structure and configured to supply external power; and a rotating part including a grounding rotation part coupled to a rotation grounding guide groove of the conducting rotation guide part and rotated along the rotation grounding guide groove while maintaining a face-to-face grounded state, a second power supply line having one side electrically connected to the hot plate installed in the lower rotation body and the upper rotation body of the hair styling part and a remaining side electrically connected to the grounding rotation part to supply external power supplied through the first power supply line to the hot plate, and a hot plate configured to dissipate heat due to heating action of current supplied through the second power supply line and being capable of being continuously rotated clockwise or counterclockwise.

9. The multifunctional hair styling beauty electric heating device having grounding continuity in a rotation state according to claim 6 or 7, wherein the plurality of conducting rotation guide parts is formed to maintain a 1:1 grounded state with the grounding rotation parts through the rotation grounding guide groove.

10. The multifunctional hair styling beauty electric heating device according to claim 6 or 7, wherein the pair of hot plates is installed in inner upper and lower parts of the lower rotation body and the upper rotation body, respectively, and is configured to dissipate heat through an entire surface including a surface at which the lower rotation body and the upper rotation body are in contact with each other and an outer circumferential surface.

11. The multifunctional hair styling beauty electric heating device having grounding continuity in a rotation state according to claim 6 or 7, wherein the pair of hot plates is installed in inner upper and lower parts of the lower rotation body and the upper rotation body, respectively, and is configured to manipulate the lower rotation body and the upper rotation body to maintain different temperatures.

12. The multifunctional hair styling beauty electric heating device having grounding continuity in a rotation state according to claim 6, wherein the grip body part includes a lock button formed on an outer lower surface thereof and having a rotation lock function for blocking and releasing rotation of the hair styling part.

* * * * *